US007609001B2

(12) United States Patent
Small

(10) Patent No.: US 7,609,001 B2
(45) **Date of Patent: *Oct. 27, 2009**

(54) OPTICAL MAGNETRON FOR HIGH EFFICIENCY PRODUCTION OF OPTICAL RADIATION AND RELATED METHODS OF USE

(75) Inventor: James G. Small, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 288 days.

This patent is subject to a terminal disclaimer.

(21) Appl. No.: 11/567,388

(22) Filed: Dec. 6, 2006

(65) Prior Publication Data

US 2008/0296508 A1 Dec. 4, 2008

Related U.S. Application Data

(63) Continuation-in-part of application No. 10/982,591, filed on Nov. 5, 2004, now Pat. No. 7,265,360.

(51) Int. Cl.
*H01J 25/50* (2006.01)

(52) U.S. Cl. ..... 315/39.51; 315/39.53; 315/39.65; 315/39.75

(58) Field of Classification Search ..... 315/39.51, 315/39.65, 39.73, 39.75, 39.77, 39.53
See application file for complete search history.

(56) References Cited

U.S. PATENT DOCUMENTS

| | | | | |
|---|---|---|---|---|
| 4,465,953 | A | 8/1984 | Bekefi | |
| 4,588,965 | A | 5/1986 | Cook | |
| 5,676,873 | A | 10/1997 | Takase et al. | |
| 5,786,923 | A | 7/1998 | Doucet et al. | |
| 6,259,208 | B1 | 7/2001 | Crouch | |
| 6,373,194 | B1 | 4/2002 | Small | |
| 6,504,303 | B2 | 1/2003 | Small | |
| 6,525,477 | B2 | 2/2003 | Small | |
| 6,650,451 | B1 | 11/2003 | Byers et al. | |
| 6,697,192 | B1 | 2/2004 | Fan et al. | |
| 6,724,146 | B2 | 4/2004 | Small | |
| 7,257,327 | B2 * | 8/2007 | Small | 398/118 |
| 7,265,360 | B2 * | 9/2007 | Baker et al. | 250/393 |
| 2002/0171897 | A1 | 11/2002 | Cho et al. | |
| 2006/0097183 | A1 | 5/2006 | Baker et al. | |

FOREIGN PATENT DOCUMENTS

| | | |
|---|---|---|
| WO | 00/25455 | 5/2000 |
| WO | 01/97250 A2 | 12/2001 |

OTHER PUBLICATIONS

PCT/US03/27036; Annex to Form PCT/ISA/206 Communication Relating to the Results of the Partial International Search mailed Jan. 30, 2004.

* cited by examiner

*Primary Examiner*—Douglas W. Owens
*Assistant Examiner*—Chuc Tran
(74) *Attorney, Agent, or Firm*—Renner, Otto, Boisselle & Sklar, LLP

(57) ABSTRACT

An electromagnetic radiation source is disclosed that produces a single mode operation at a desired operating frequency. The electromagnetic radiation source is included in a wide variety of applications including a wireless power transmission system, a system for providing wireless/high-bandwidth communications in accordance with the present invention, a lighting system, an irradiation system, a weapons system, etc.

20 Claims, 14 Drawing Sheets

SMALL DIAMETER

PI MODE = 7.201 GHz

Q = 544

OPTICAL MAGNETRON FOR HIGH EFFICIENCY PRODUCTION OF OPTICAL RADIATION AND RELATED METHODS OF USE

RELATED APPLICATIONS

This application is a continuation-in-part of U.S. patent application Ser. No. 10/982,591, filed Nov. 5, 2004, now U.S. Pat. No. 7,265,360 which is hereby incorporated herein by reference in its entirety.

FIELD OF THE INVENTION

The present invention relates generally to light sources, and more particularly to a high efficiency light source in the form of an optical magnetron and related applications.

BACKGROUND OF THE INVENTION

Magnetrons are well known in the art and have long served as highly efficient sources of microwave energy. For example, magnetrons are commonly employed in microwave ovens to generate sufficient microwave energy for heating and cooking various foods. The use of magnetrons is desirable in that they operate with high efficiency, thus avoiding high costs associated with excess power consumption, heat dissipation, etc.

Conventional microwave magnetrons employ a constant electric and magnetic field to produce a rotating electron space charge. The electron space charge interacts with a plurality of microwave resonant cavities to generate microwave radiation. Conventional magnetrons are efficient generators of microwave energy for frequencies in the 1 to 10 GHz region. At higher frequencies, the maximum output power drops and the required electric and magnetic field strength increases (at higher frequencies the resonant cavities become proportionally smaller). The practical upper frequency limit for conventional magnetron designs is about 100 GHz at about 1 Watt (W) of continuous power. By comparison, at 1 GHz, conventional magnetrons can produce several kilowatts of continuous power. In short pulses, most magnetron designs can produce peak powers 1000 times higher than their maximum continuous power levels. In pulse operation, multi-megawatt power levels are possible in the 1 to 10 GHz range.

Conventional magnetrons employ anodes which have a plurality of resonant cavities arranged around a cylindrical cathode. The resonant cavities typically number from six to twenty. They may be shaped as hole and slot-keyhole structures or as straight-sided pie-shaped structures. FIGS. 1A-1C illustrate several conventional magnetron anode designs, namely, the slot-keyhole, the straight-sided pie-shaped structure and the rising sun structure (i.e., an anode with resonant cavities having varying dimensions), respectively.

Mode control is an important issue in magnetron operation. A mode is a collective oscillation of all of the resonant cavities. In a single mode, all of the cavities may oscillate at substantially the same frequency but with some phase difference between adjacent cavities. The most desirable mode of operation occurs when adjacent cavities oscillate 180 degrees out of phase with each other or pi radians out of phase. This is known as pi-mode, and is the most power efficient mode. Numerous other modes are possible. For example, all cavities can oscillate in phase with each other, which is known as the zero pi-mode. Another possibility is that adjacent cavities oscillate pi/2 radians or 90 degrees out of phase with each other. In general, the number of distinct possible modes equals the number of resonant cavities. As more cavities are added, the number of possible modes increases.

Without some sort of mode control device, a magnetron can and will oscillate at any possible mode. Each mode has a slightly different oscillation frequency and power efficiency. Without mode control, a magnetron oscillator will jump about in frequency and power level in an uncontrolled manner.

The frequency and power limitations of conventional magnetron designs arise from a breakdown of mode control. Mode control is conventionally accomplished either by using strapping rings 10 as shown in FIGS. 1A and 1B, or by alternating the size of the resonant cavities 12 as in the rising sun design of FIG. 1C. As a practical matter, these prior art methods of mode control fail when the number of cavities exceed approximately twenty. Numbers higher than forty heretofore have been considered completely impractical.

Since the spacing of anode pole pieces depends directly on the operating wavelength, this limitation drives higher frequency designs to very small size and limits their power handling capability. The very small size also requires very large magnetic fields to maintain small radius electron orbits within the small device. At 100 GHz for example, the resonant cavities are reduced to a fraction of a millimeter in length. Such small pieces of metal may cause problems as a result of being unable to handle high-power levels without melting. Furthermore, as the anode diameter becomes smaller, impractically large magnetic fields are required to produce tighter electron orbits around the cathode.

With reference to FIG. 2, a conventional cylindrical magnetron 14 is provided with a central electron emitting cathode 16 and a circumferential anode 18 containing a plurality of resonant cavities 12. A high voltage source (not shown) is used to accelerate electrons from the cathode 16 to the anode 18 (the cathode is at negative potential and the anode is at positive potential), and an axial magnetic field 20 causes the electrons to follow curved orbits on their way from the cathode 16 to the anode 18. A power coupling port 19 provides a means to deliver the energy away from the resonant cavities 12. Planar (non-curved) magnetrons are also possible with similar operating principles. For clarity, only cylindrical magnetrons will be discussed.

During operation of the magnetron 14, an electron cloud rotates about an axis of symmetry within an interaction space, e.g., the space between the anode and cathode. As the cloud rotates, the electron distribution becomes bunched on its outer surface, thereby forming spokes of electronic charge that resemble the teeth on a gear. The operating frequency of the magnetron is determined by how rapidly the spokes pass from one gap to the next in one half of the oscillation period. The electron rotational velocity is determined primarily by the strength of a permanent magnetic field and the electric field which are applied to the interaction region.

FIG. 3 illustrates an expanded view of a portion of a conventional magnetron anode 18 in pi-mode operation. For simplicity, the curved structure is drawn straight. When operating in the desired pi-mode, adjacent resonant cavities 12 oscillate out of phase with each other. The space between the cathode and anode is filled with a rotating electron cloud 22. A high voltage accelerates the electrons from cathode 16 to anode 18 and supplies the electrical energy which is converted into microwave power.

At an instant of time during pi-mode operation, it can be seen that the microwave fringing fields 24 at the resonant cavity openings have alternating directions. The circulating electron cloud 22 sees electric fields across consecutive openings which go from plus to minus potential, then minus to plus, then plus to minus, etc. The result is that the surface of the metal pole pieces 26 between resonant cavity openings are alternately at either positive or negative potential. Since electrons are attracted to positive and repelled from negative potentials, pi-mode operation serves to efficiently bunch the electron cloud 22.

The rotating electron cloud 22 interacts only with the fringing fields 24 between anode poles. The function of the multiplicity of microwave resonators 12 is to support and maintain the oscillating fringing fields 24. As taught in commonly assigned U.S. Pat. No. 6,724,146, a multiplicity of microwave resonators is not necessary to produce magnetron operation. It is sufficient to provide a multiplicity of anode pole pieces that support pi-mode at fringing fields across the anode openings.

For many practical reasons, the distance D between anode openings is typically a fraction of the operating wavelength, such as, for example, one-tenth or one-hundredth of the operating free space wavelength. The anode circumference of a typical prior art microwave-oven magnetron is about one-half the guided-wave wavelength and contains ten resonators for a spacing D of about 1/20 wavelength. It is also known as a practical matter that mode control fails for magnetrons constructed with more than approximately twenty resonant cavities 12. From these two facts it can be seen that mode control is difficult when the circumference of the anode is larger than approximately one wavelength at the operating frequency.

Recently, the applicant has described a high frequency magnetron that is suitable for operating at frequencies heretofore not possible with conventional magnetrons. This high frequency magnetron is capable of producing high efficiency, high power electromagnetic energy at frequencies within the infrared and visible light bands, and which may extend beyond into higher frequency bands such as ultraviolet, x-ray, etc. As a result, the magnetron may serve as a light source in a variety of applications such as long distance optical communications, commercial and industrial lighting, manufacturing, etc. Such magnetron is described in detail in commonly assigned, U.S. Pat. No. 6,373,194 and U.S. Pat. No. 6,504,303, the entire disclosures of which are incorporated herein by reference.

This high frequency magnetron is advantageous as it does not require extremely high magnetic fields. Rather, the magnetron preferably uses a magnetic field of more reasonable strength, and more preferably a magnetic field obtained from permanent magnets. The magnetic field strength determines the radius of rotation and angular velocity of the electron space charge within the interaction region between the cathode and the anode. The anode includes a plurality of small resonant cavities which are sized according to the desired operating wavelength. A mechanism is provided for constraining the plurality of resonant cavities to operate in pi-mode. Specifically, each resonant cavity is constrained to oscillate pi-radians out of phase with the resonant cavities immediately adjacent thereto. An output coupler or coupler array is provided to couple optical radiation away from the resonant cavities in order to deliver useful output power.

Additionally, applicant has made further improvements to the magnetron, wherein the wavelength of operation may be in the microwave band, infrared light or visible light bands, or even shorter wavelengths. The magnetron converts direct current (dc) electricity into single-frequency electromagnetic radiation, and includes an array of phasing lines and/or inter-digitated electrodes that are disposed around the outer circumference of an electron interaction space. During operation, oscillating electric fields appear in gaps between adjacent phasing lines/inter-digitated electrodes in the array. The electric fields are constrained to point in opposite directions in adjacent gaps, thus providing pi-mode fields that are necessary for efficient magnetron operation. Such a magnetron is described in detail in commonly assigned U.S. Pat. No. 6,724,146, the entire disclosure of which is incorporated herein by reference.

Nevertheless, a strong need remains in the art for even further advances in the development of high frequency electromagnetic radiation sources. For example, a strong need remains for a device having improved operation at high frequencies, e.g., over 100 GHz, while operating at high power levels. More particularly, a strong need remains for a device which does not utilize multiple resonant cavities, thereby simplifying the construction of the magnetron. Such a device would offer greater design flexibility and would be particularly well suited for producing electromagnetic radiation at very short wavelengths and operating at high power levels.

SUMMARY OF THE INVENTION

One aspect of the invention relates to an electromagnetic radiation source. The electromagnetic radiation source includes an anode having a first conductor; a second conductor positioned relative to the first conductor; a plurality of inter-digitated pole pieces coupled to the first conductor or the second conductor, wherein adjacent pole pieces are separated by a gap; at least one mechanical phase reversal positioned along the first conductor or the second conductor, the mechanical phase reversal forcing a polarity change between pole pieces adjacent to the mechanical phase reversal. The electromagnetic radiation source further includes a cathode separated from the anode by an anode-cathode space; electrical contacts for applying a dc voltage between the anode and the cathode and establishing an electric field across the anode-cathode space; and at least one magnet arranged to provide a dc magnetic field within the anode-cathode space generally normal to the electric field.

Other aspects of the invention are directed to an exemplary electromagnetic radiation source (e.g., optical magnetron) in a variety of systems including a welding system, a process heating system, an optical power transmission system, a wireless/high-bandwidth communications system, a cutting system, a lighting system, a medical diagnostics system, a medical therapy system, a system for killing insects, a system for killing plants, a directed energy weapon system, a system for converting direct current to optical power, a system for wirelessly providing electrical power to an aircraft, a system for wirelessly providing power to a satellite, a system for wirelessly transmitting electrical power from a space-based power generation station to earth, a pollution remediation system, a photochemical processing system, and a display system.

BRIEF DESCRIPTION OF THE DRAWINGS

FIG. 7A shows standing wave resonances in an exemplary anode with a circumference of 2 free-space wavelengths;

DESCRIPTION OF THE INVENTION

Figure 1A:
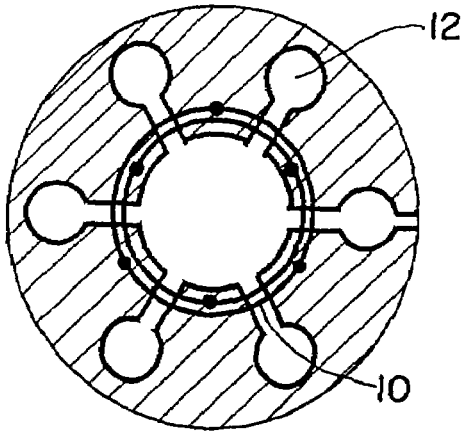
FIG. 1A is a schematic view of a prior art magnetron anode utilizing a slot-keyhole resonator design.
Figure 1B:
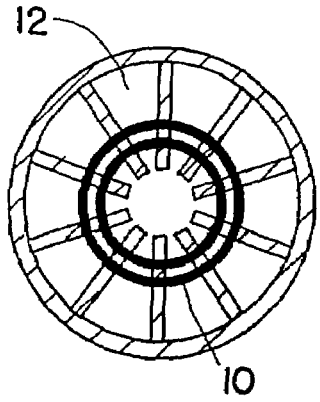
FIG. 1B is a schematic view of a prior art magnetron anode utilizing a straight-sided pie-shape resonator design.
Figure 1C:
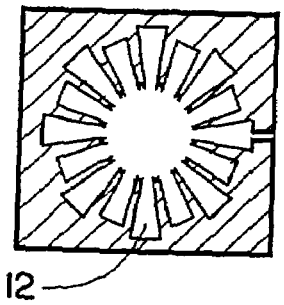
FIG. 1C is a schematic view of a prior art magnetron anode utilizing resonators having various dimensions.
Figure 2:
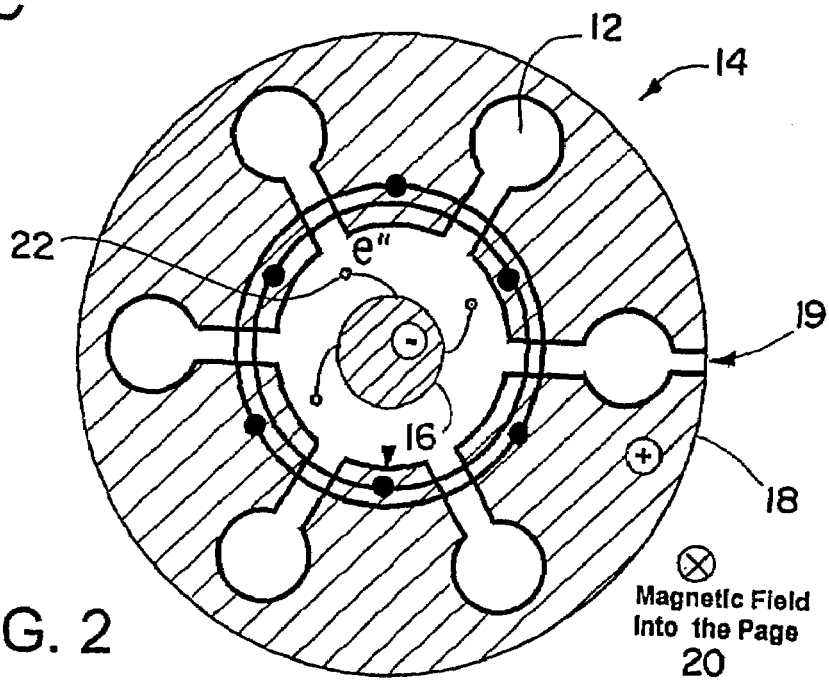
FIG. 2 illustrates a prior art magnetron utilizing the anode of FIG. 1B.
Figure 3:
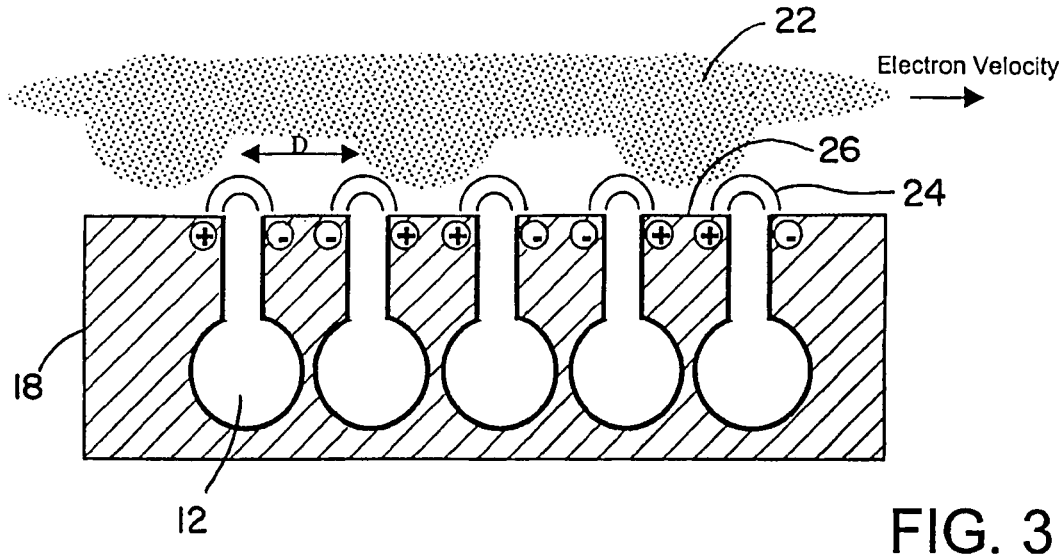
FIG. 3 is an expanded view of a portion of the anode of the magnetron of FIG. 2 during pi-mode operation.

The following is a description of the present invention with reference to the attached drawings, wherein like reference numerals will refer to like elements throughout. To illustrate the present invention in a clear and concise manner, the drawings may not necessarily be to scale.

The applicants have discovered that large anodes, e.g., anodes with a circumference larger than one free-space wavelength, exhibit traveling waves along the inner circumference of the anode. In other words, the surface of the anode supports creeping waves that propagate around the circumference of the anode in both clockwise and counterclockwise directions. The traveling waves change phase as they travel around the anode and, at certain operating frequencies, look like standing waves, e.g., they are in phase with themselves as they complete one revolution around the anode. These stationary or standing modes perturb and control the phase of the individual resonators, thereby making pi-mode operation for conventional magnetron anodes sometimes difficult or impossible to achieve.

Figure 4:
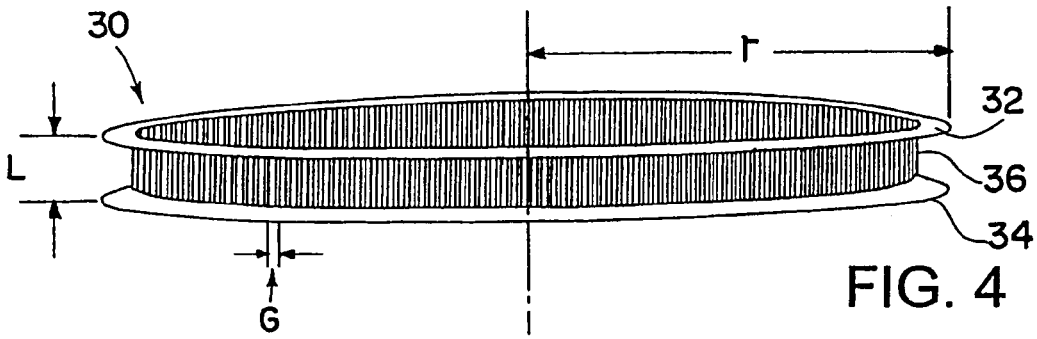
FIG. 4 is an isometric view of an exemplary anode in accordance with an embodiment of the invention.

Referring to FIG. 4, an anode 30 in accordance with an embodiment of the present invention is shown. The anode 30 need not include discrete microwave resonators. Instead, resonance is provided by standing wave modes and pi-mode electric fields are developed in conjunction with multiple poles having gaps formed between adjacent poles, wherein the length of the run is greater than the operating wavelength $\lambda$, preferably greater than $2\lambda$, and more preferably greater than $3\lambda$. Additionally, in accordance with the present invention a mechanical phase reversal of the poles is introduced every ½λ of the standing wave. Note that the wavelength of the standing and traveling waves is much shorter (about 5-times shorter) than the wavelength of a free-space wave of similar frequency. As used herein, a "run" refers to the length of the anode. An annular anode, for example, has a run that is equal to the circumference of the anode. A flat anode, on the other hand, has a run that is equal to the length of the anode.

In the embodiment of FIG. 4, the anode includes an annular top conductor 32 and an annular bottom conductor 34. The annular conductors have a radius "r" and are arranged to be concentric with respect to each other. A plurality of pins 36, which form a "ring of pins" within the anode 30, have a length "L" and are electrically coupled to the top conductor 32 or to the bottom conductor 34 and extend therefrom, wherein the pins each are separated from adjacent pins by a gap "G". The pins 36 function as anode pole pieces and, as will be discussed below, the gaps between the pins 36 provide fringing fields which interact with a rotating electron cloud (not shown).

The practical limit for the number of pins can be thousands or even millions of pins in a single anode. The large number of pins allows the fabrication of large devices with high power capability that can operate at higher frequencies and shorter wavelengths than magnetrons using conventional anode designs. Moreover, the large devices require only modest magnetic fields for operation.

The radius r of the anode 30 can vary depending on the requirements of the specific application. The length L of the pins affects the frequency of operation of the magnetron. Longer pins reduce the frequency of operation, while shorter pins increase the frequency of operation. Similarly, the pin gap G between pins also affects the frequency of operation of the magnetron. In one embodiment, the gap or spacing between pins is such that there are 10 to 20 pins per standing wavelength along the circumference of the anode. The cross sectional shape of the pins can be rectangular, triangular, circular, or any other geometrical shape.

Figure 5A:
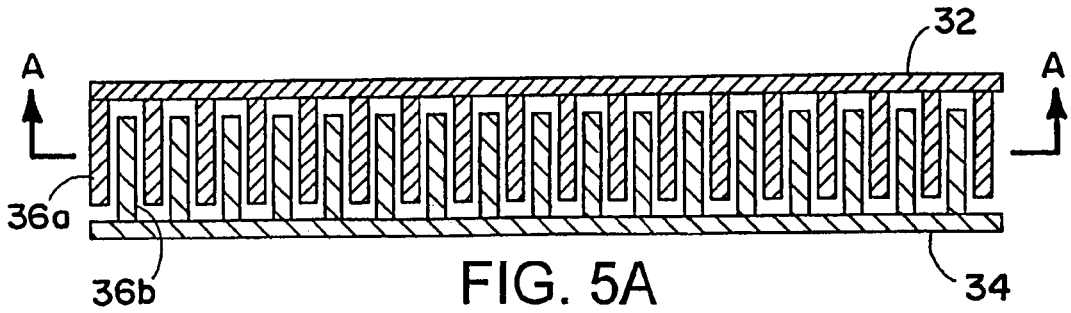
FIG. 5A is a schematic view of the rings of the exemplary anode of FIG. 4.

The top and bottom conductors 32, 34 of the anode 30 may be viewed as conductors in a parallel wire transmission line, wherein the transmission line is connected back upon itself in a large circle. As was noted above, some pins 36 are connected to the top conductor, while other pins are connected to the bottom conductor. FIG. 5A illustrates this aspect of the anode, wherein top pins 36*a* are connected to the top conductor 32, and bottom pins 36*b* are connected to the bottom conductor 34. Generally speaking, the pins 36 are configured so as to provide an inter-digitated structure. More specifically, top pins 36*a* of the top conductor 32 mesh with bottom pins 36*b* of the bottom conductor 34. As used herein, mesh refers to an alternating pattern between at least two objects, wherein the objects do not contact one another.

Figure 6A:
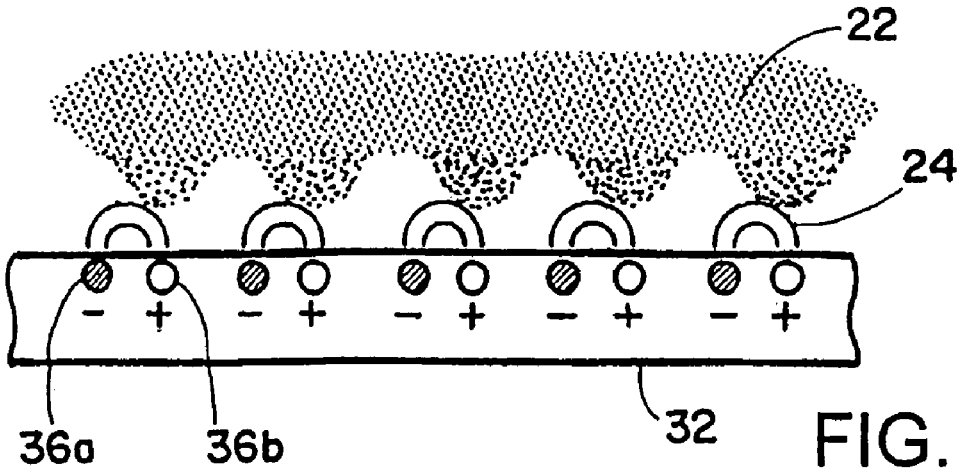
FIG. 6A is a sectional view of the exemplary anode of FIG. 4 during pi-mode operation.

The pins 36 connect to a voltage generated by the standing microwave fields on the ring. With reference to FIG. 6A, which is a cross sectional view of the anode of FIG. 5A taken along the section A-A, voltages between adjacent pins 36*a*, 36*b* provide fringing fields 24 that can interact with the circulating electron cloud 22. More specifically, the fringing fields 24 between the pins 36*a*, 36*b* exactly replicate the pi-mode fields of prior art magnetrons devices. Thus, the anode of the present invention can operate in pi-mode without the need for mode control mechanisms, e.g., strapping rings of prior art anodes.

Figure 7A:
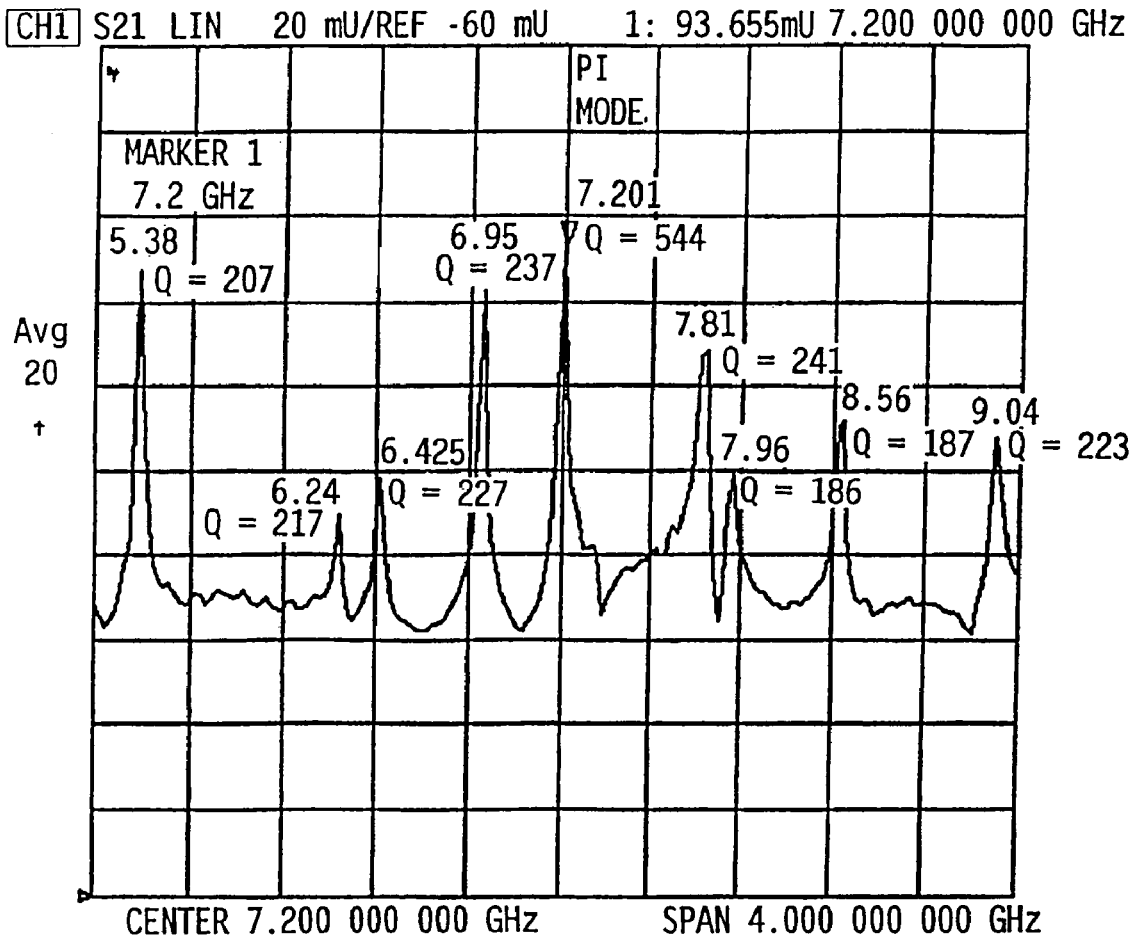
FIG. 7A is a graph illustrating the Q-factor of an embodiment of the exemplary anode in accordance with the invention with respect to prior art anodes and, more particularly.

For certain discrete frequencies, the inner circumference of the anode 30 equals an integer number of standing half wavelengths of the operating microwave frequency. At these resonance conditions, the traveling waves of microwave energy are in phase with themselves after each trip around the circumference of the ring and form standing waves. The result is a very high-Q low-loss resonance at a microwave frequency. FIG. 7A shows the results of resonance measurements in a ring of one hundred twenty pins for several modes. More specifically, the discrete modes in a ring of one hundred twenty pins show Q-values around or above 500. The Q of a conventional magnetron resonator is on the order of 100. Thus, the anode of the present invention, when utilized in a magnetron, offers a significant improvement in the Q factor when compared to magnetrons utilizing prior art anodes.

Figure 5B:
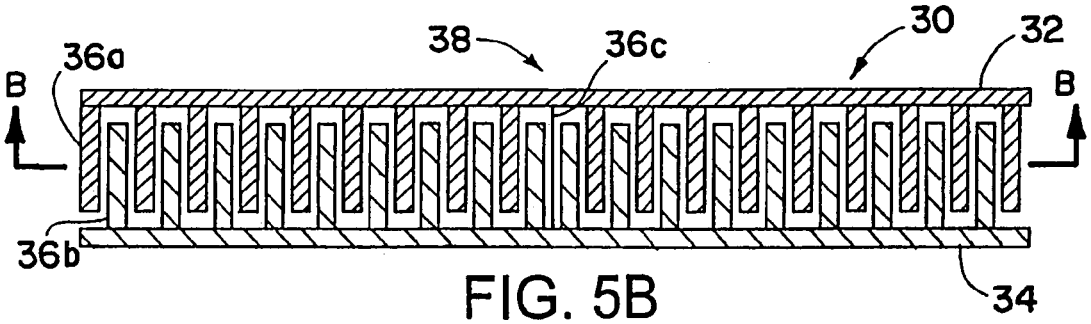
FIG. 5B is a schematic view of the rings of the exemplary anode of FIG. 4, illustrating the mechanical phase reversals.
Figure 7B:
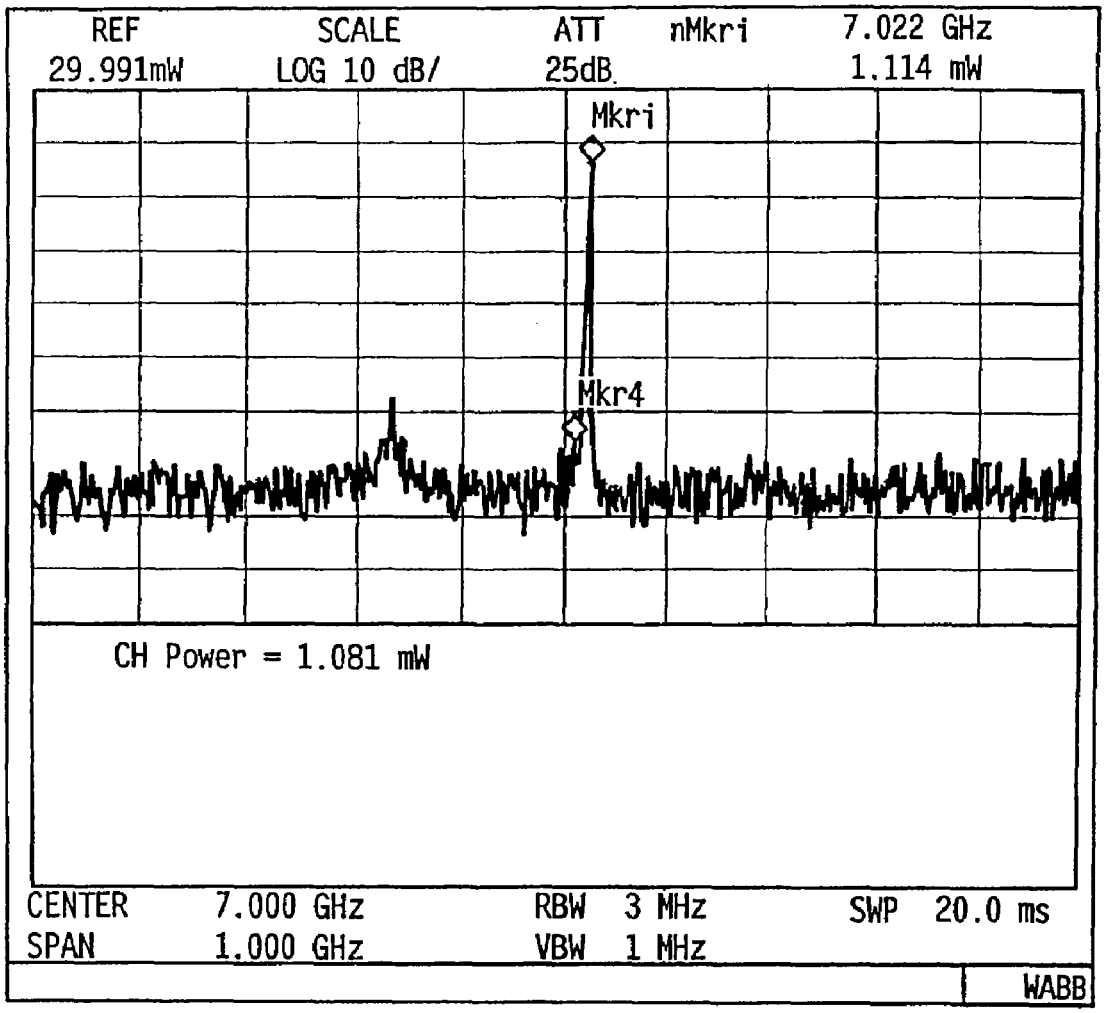
FIG. 7B is a graph of the output power from an embodiment of the exemplary anode in accordance with the invention during operation in pi-mode (Note that mechanical phase reversals have preferentially selected oscillation at only one of the modes)

At approximately every half standing wavelength around the ring, the connecting pins 36 are provided with a mechanical phase reversal 38 as shown in FIG. 5B. The microwave standing waves on the ring go through an electrical phase reversal at every half wavelength, and the mechanical phase reversal 38 forces a polarity change between the top pins 36*a* and the bottom pins 36*b* that corresponds with the phase reversal of the standing waves. In other words, the mechanical phase reversal compensates for the microwave phase reversal and, thus, presents continuously in-phase pi-mode fields to the circulating electrons. The mechanical phase reversal ensures that a particular mode of operation, such as a desired single operating frequency, for example, is maintained. FIG. 7B shows the microwave output power from the anode of FIG. 7A where the mechanical phase reversals have been designed to select only one of the possible standing wave modes. The result is a pure single mode operation. As will be appreciated by those skilled in the art, one or more mechanical phase reversals 38 can be placed along the anode to support a single operating mode at any of the possible anode resonances.

The orientation of the phase reversals 38 can alternate between the top conductor 32 and the bottom conductor 34. For example, a first mechanical phase reversal can have both pins coupled to the top conductor 32, and the next mechanical phase reversal can have both pins coupled to the bottom conductor 34.

The mechanical phase reversal can be implemented, for example, by forming the pins 36 such that two pins connected to the same conductor are adjacent to each other. In other words, the pins of one conductor, e.g., the top conductor 32, do not mesh with corresponding pins of the other conductor, e.g., the bottom conductor 34. By this manner, the circulating electrons continually see pi-mode fields which do not reverse in phase and which remain synchronous with the electron motion. The spacing between pins of the mechanical phase reversal is the same as the spacing between other pins, e.g., a gap "G" between pins of the mechanical phase reversal.

The position of the standing wave can float or drift along the surface of the anode. To anchor the position of the standing wave, a shorting bar 36*c* is electrically coupled between the top conductor 32 and the bottom conductor 34, thereby providing a solid reference point. More specifically, the shorting bar 36*c* is placed between one pair of mechanical phase reversals 38. Any remaining mechanical phase reversals do not include the shorting bar 36*c*. With the shorting bar 36*c*, the location of the standing wave is fixed.

Figure 6B:
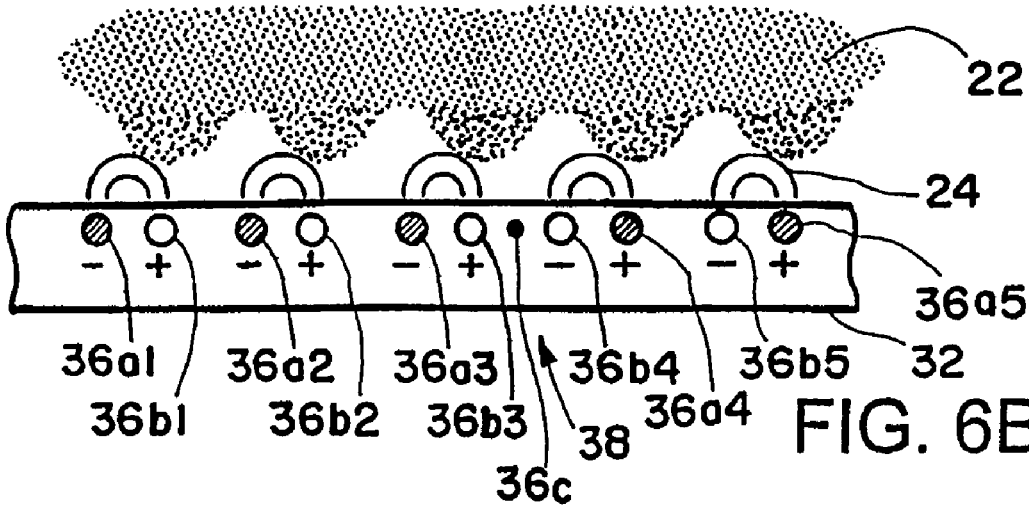
FIG. 6B is a sectional view of the exemplary anode of FIGS. 4 and 5 during pi-mode operation, illustrating the effect of the mechanical phase reversal.

FIG. 6B, which is a cross sectional view of the anode of FIG. 5B taken along section B-B, illustrates the effect of the mechanical phase reversal 38 on pi-mode operation. As was previously described, the pins 36 connect to a voltage generated by the standing microwave fields on the ring. Assuming a negative charge develops on a first top pin 36*a*1 and a positive charge develops on an adjacent bottom pin 36*b*1, then a negative charge develops on the next top pin 36*a*2, while a positive charge develops on the next adjacent bottom pin 36*b*2. This pattern, e.g., negative (top pin)-positive (bottom pin), negative (top pin)-positive (bottom pin), etc., continues as before until the mechanical phase reversal 38.

At the mechanical phase reversal 38, two bottom pins 36*b*3, 36*b*4 are adjacent to each other. Following the above pattern, a positive charge develops on bottom pin 36*b*3, a negative charge develops on adjacent bottom pin 36*b*4, and a positive charge develops on the next top pin 36*a*4. Thus, the polarity of the top and bottom pins has been shifted or reversed. Moreover, this reversal corresponds to the phase reversal of the standing waves. Thus, even though the standing waves undergo a phase reversal, thereby changing the polarity of the standing wave voltage, the mechanical phase reversal 38 compensates for the polarity change by changing the polarity of the top and bottom pins, thereby replicating the pi-mode fields of prior art magnetrons and therefore maintaining pi-mode operation. The shorting bar 36*c* locks the position of the standing wave on the anode.

Figure 8A:
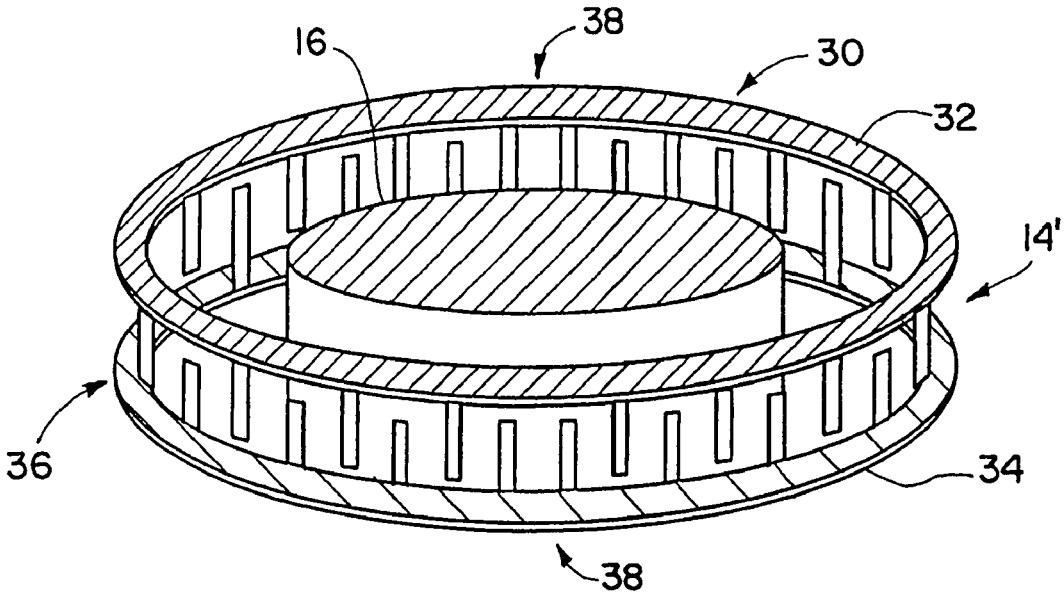
FIG. 8A is an isometric view of an exemplary magnetron incorporating an exemplary anode in accordance with an embodiment of the present invention.
Figure 8B:
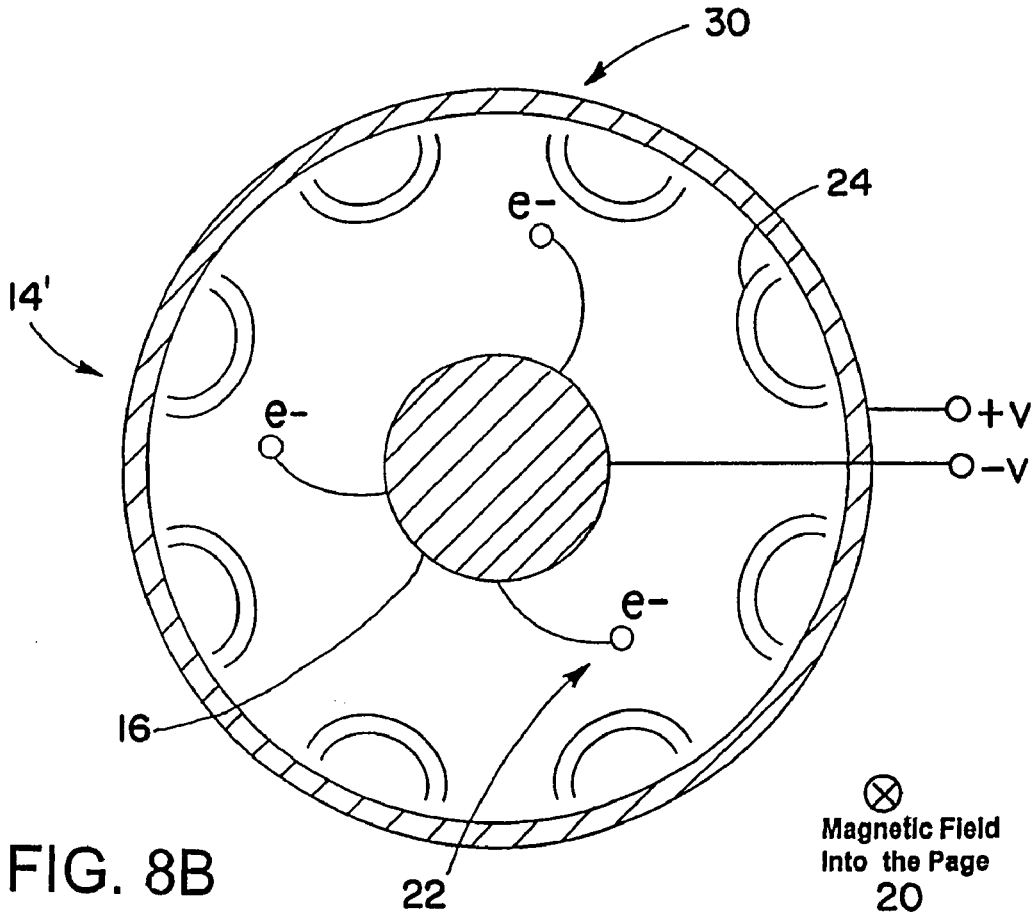
FIG. 8B is a top view of the exemplary magnetron of FIG. 8A.

FIGS. 8A and 8B illustrate a magnetron 14' incorporating an anode 30 in accordance with an embodiment of the present invention. The magnetron includes the anode 30 and a cathode 16 separated by an interaction space (or anode-cathode space), electrical contacts +V, −V for applying a voltage to the anode and cathode, and a magnet (not shown), which produces a magnetic field 20. Operation of the magnetron 14' will now be described.

A high voltage (not shown) is applied between the cathode 16 and anode 30 via the contacts +V, −V as is conventional, and the high voltage accelerates electrons from the cathode to the anode, thereby creating a circulating electron cloud 22. As the cloud moves through an interaction space (e.g., the space between the anode and cathode), traveling wave modes, which prevent mode control in magnetrons utilizing conventional anodes, form and develop a charge on the pins 36 that creates fringing fields 24. The fringing fields 24 replicate pi-mode fields of prior art magnetrons. More specifically, and with further reference to FIG. 6B, the traveling wave modes create a resonance whereby a negative charge develops on a first pin 36*a*1 and a positive charge develops on an adjacent pin 36*b*1. The next adjacent pin 36*a*2 develops a negative charge and the next adjacent 36*b*2 pin develops a positive charge, etc. The circulating electron cloud 22 interacts with the developed charge, e.g., electrons are attracted to the positive charge and repelled from the negative charge, thereby efficiently bunching the electron cloud. As the standing waves go through an electrical phase reversal, which occurs at every half wavelength, the mechanical phase reversals 38 force a change in polarity of the pins 36, as shown in FIG. 6B, thereby maintaining pi-mode operation.

The anode 30 of the present invention can be substantially larger than one-wavelength in circumference at the operating frequency while maintaining mode control. This is significant since magnetrons utilizing prior art anodes would experience failure of mode control when the circumference of the anode became larger than approximately one wavelength at the operating frequency. Additionally, the anode of the present invention permits large electron orbits and thus can operate using small magnetic fields at short wavelength operation. Furthermore, and unlike conventional magnetron anodes, the anode 30 permits mode control with a large number of pole pieces.

Figure 9:
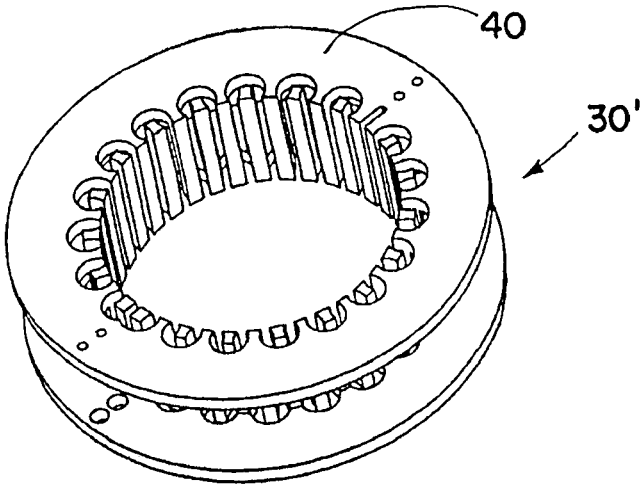
FIG. 9 is an isometric view of an anode in accordance with another embodiment of the invention.

With reference to FIG. 9, a forty pin structure in accordance with an embodiment of the anode is shown. The anode 30' includes a supporting flange 40 integrally formed with the ring of pins 36. During operation, the traveling waves, which circulate about the ring of pins, are closely attached to the space surrounding the pins 36. Significant power levels extend outward from the ring by only about two pin spacings. Thus, the circulating power and mode frequency are largely unaffected by the addition of flanges or support structures. Additionally, the power stays near the pins and does not travel outward on the flanges. As should be appreciated, the size of the flange can vary based on the specific requirements. Moreover, various flange sizes will not degrade performance of the anode.

Figure 10:
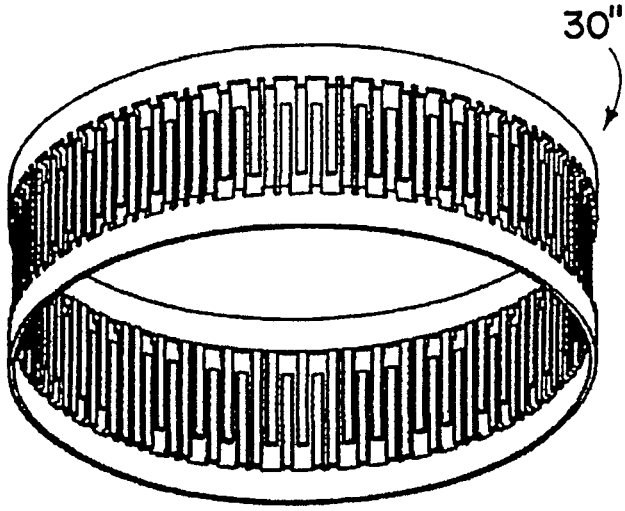
FIG. 10 is an isometric view of an anode in accordance with yet another embodiment of the invention.
Figure 12:
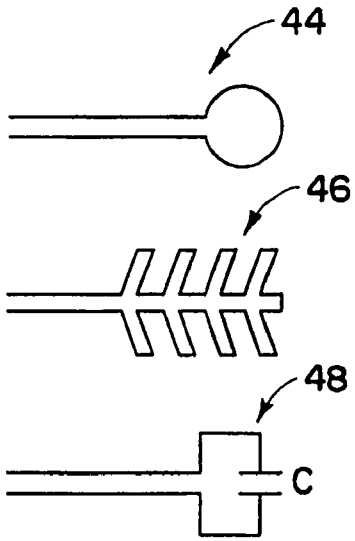
FIG. 12 is a schematic view of several probes in accordance with an embodiment of the invention.
Figure 11:
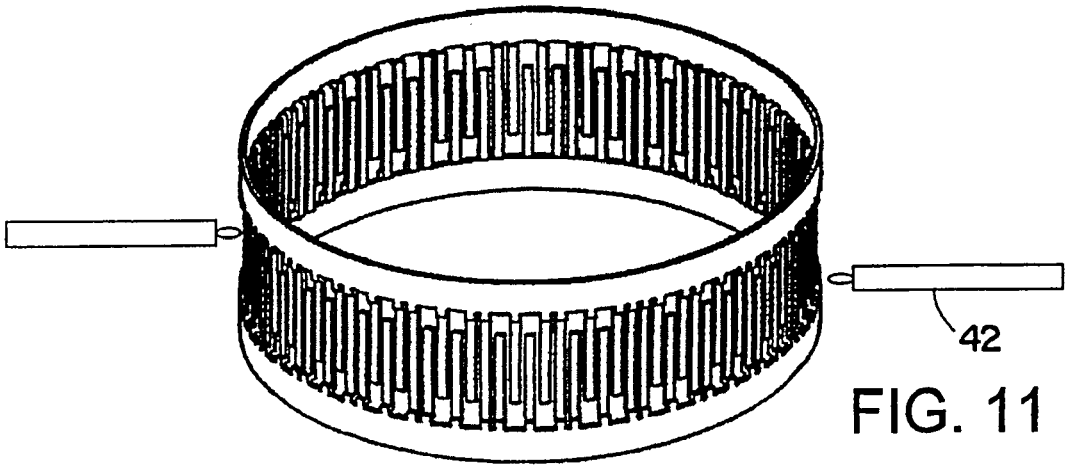
FIG. 11 is an isometric view of an anode and coupling probes in accordance with an embodiment of the invention.

FIG. 10 illustrates a one hundred twenty pin structure in accordance with another embodiment of the anode. The anode 30", in contrast to the embodiment of FIG. 9, has almost no supporting flanges. In both embodiments, output coupling probes 42 are placed closely to the pins 36 to couple to the tightly bound circulating power, as illustrated in FIG. 11. The coupling probes provide a means to deliver the energy from the pins to a remote area or device. The coupling probes can be capacitively and/or inductively coupled to the anode. Inductively and capacitively coupled probes should be placed within two pin-spacings of the ring of pins 36. FIG. 12 illustrates several embodiments of coupling probes, including inductive loops 44, small metal antennas 46, and dielectric probes 48 that sample the electric field of the circulating waves.

Alternatively, the coupling probes can be directly connected to the anode via one of the mechanical phase reversals 38. For example, a first conductor can be coupled to one pin of a mechanical phase reversal, and a second conductor can be coupled to a second pin of the same mechanical phase reversal, wherein the power output is the differential between the two conductors. The conductors can be coupled at the midpoint of the each respective pin of the mechanical phase reversal.

Figure 13:
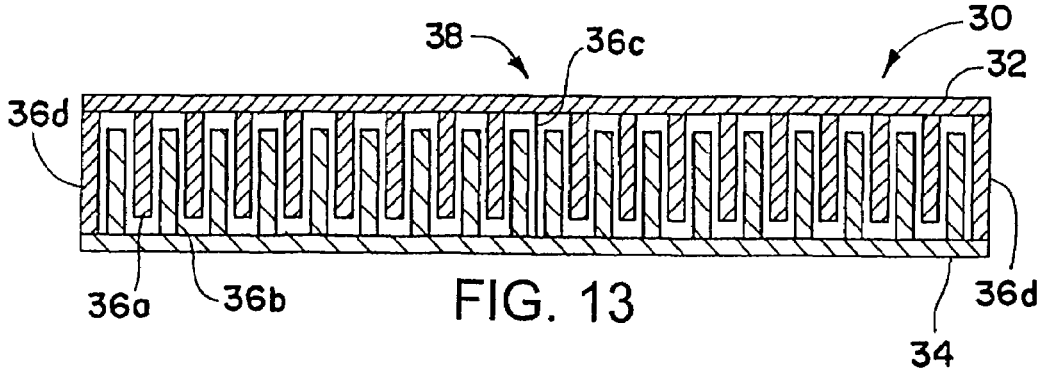
FIG. 13 is a schematic view of the rings of the anode of FIG. 4 illustrating the coupling pins between conductors.

In addition to annular shaped anodes, non-annular structures also are practical. Similar microwave resonances found in annular shaped anodes are observed in straight or curved sections of transmission lines that are provided with short-circuit pins 36*d* at their ends, as shown in FIG. 13.

For practical designs that may require very large numbers of pins, it is feasible to break up a large ring into several sectors. Non-ring structures may be used as stand-alone arcs in very large cylindrical magnetrons. An optical resonator can be employed with the arcs to enhance performance at short operating wavelengths. Non-ring structures also can be used in planar (cylindrical) magnetrons devices. Alternatively, a large anode may be formed from several independent subsections that are coupled together to form the anode structure.

Figure 14A:
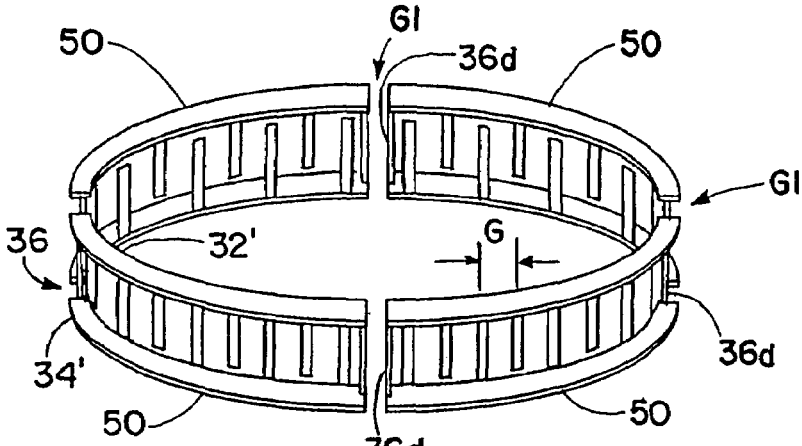
FIG. 14A is an isometric view on an anode structure in accordance with another embodiment of the invention.
Figure 14B:
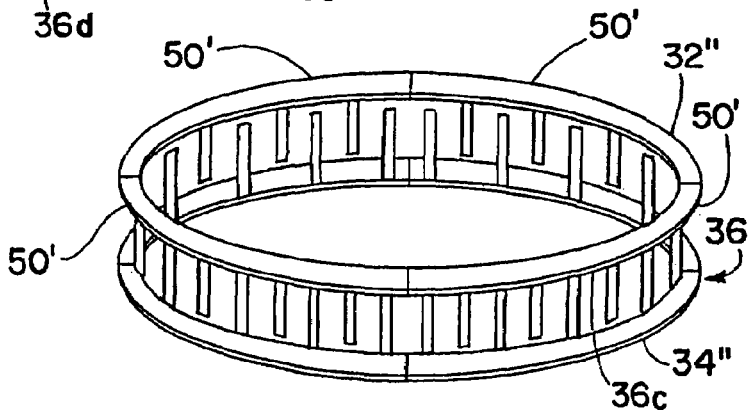
FIG. 14B is an isometric view on an anode structure in accordance with yet another embodiment of the invention.

For example, and with reference to FIG. 14A, four arcs 50 are used to form a general anode structure. The arcs 50 are similar to the anode 30, except they do not form one continuous anode structure, and they include shorting pins 36*d* at the ends of each arc. Each arc is separated from an adjacent arc by a gap G1, wherein G1 is an integer multiple of the gap G between adjacent pins of the arc. Each arc includes a top conductor 32' and a bottom conductor 34', and a plurality of pins 36 connected to the top, bottom or both conductors as previously described. FIG. 14B illustrates an anode similar to the anode of FIG. 14A, except the anode is formed from four separate arcs 50' that are coupled together to form a continuous anode structure. Each arc includes a top conductor 32" and a bottom conductor 34", and a plurality of pins 36 connected to the top, bottom or both conductors.

Figure 15:
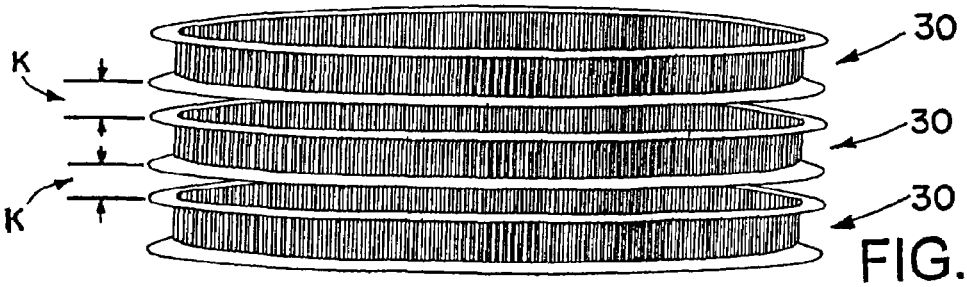
FIG. 15 is an isometric view of three stacked anodes in accordance with an embodiment of the invention.

Anodes in accordance with the present invention may be stacked one above another as shown in FIG. 15. Stacking allows the anode to have a larger area and higher power handling capability than would be possible with a single ring anode design. Additionally, anodes 30 preserve their high-Q low-loss resonance when stacked, provided a minimal spacing "K" exists between the anodes. In general the spacing K between anodes should be no smaller than the spacing G between adjacent pins 36 in the anode. If the spacing K is on the order of two pin spacings, the anodes interact sufficiently to induce frequency locking between anodes. In this manner, a single pi-mode resonator may be constructed with thousands of times the area and power handling capability of conventional magnetrons anode designs.

Accordingly, an anode for use in a magnetron has been disclosed that permits single mode operation while including substantially more than one-hundred pole pieces. Moreover, the anode eliminates the prior art requirement for a multiplicity of microwave resonators. The multiplicity of resonators are replaced with a ring of pins, which serve to provide a high quality microwave resonance and to present pi-mode electric fields to the circulating electron cloud. The circumference of the anode can be substantially larger than one-wavelength of the operating frequency, and the anode, whether cylindrical or planar, may be stacked for large area and high power handling capability. Furthermore, the anode in accordance with the present invention permits large electron orbits and, therefore, small magnetic fields at short wavelength operation. The anode also may be segmented into multiple sectors, thereby facilitating the fabrication of large anode designs.

Figure 16:
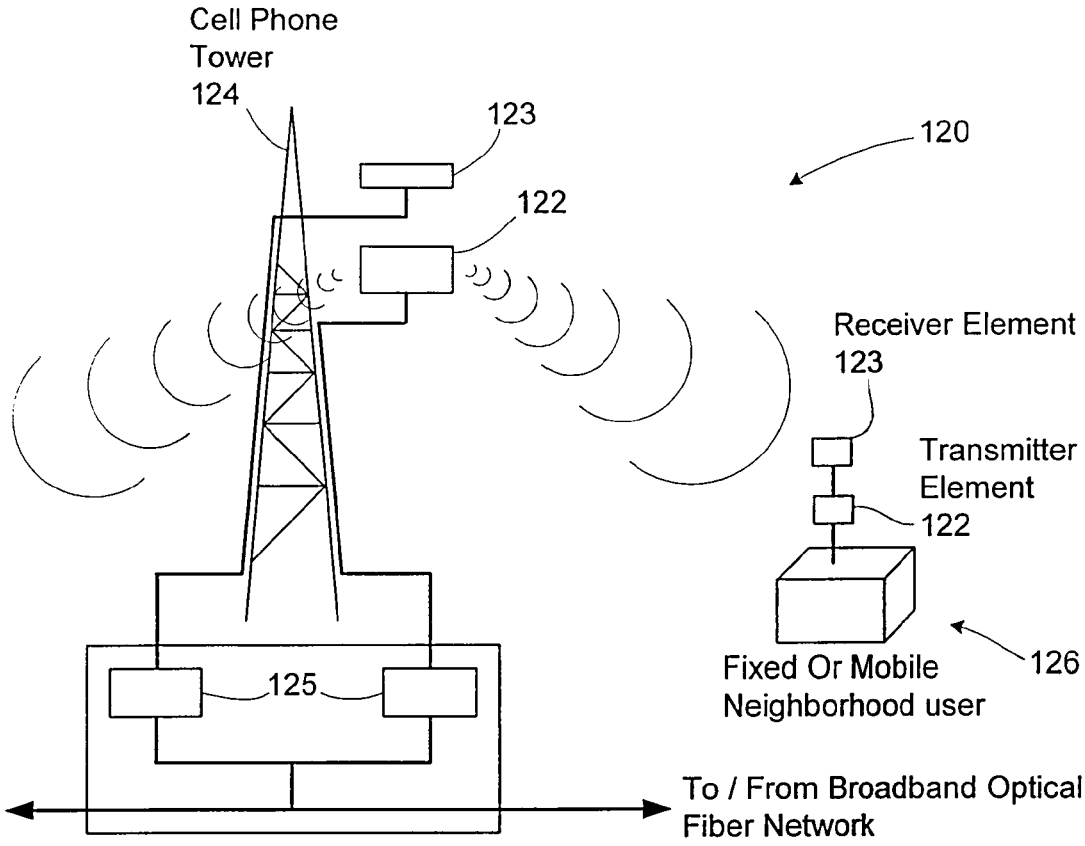
FIG. 16 is a schematic diagram illustrating an exemplary optical magnetron in a system for providing wireless/high-bandwidth communications in accordance with the present invention.

Turning to FIG. 16, an exemplary optical magnetron 122 is shown in a system 120 for providing wireless/high-bandwidth communications. The system 120 includes a transmitting optical magnetron 122 for transmitting electromagnetic radiation, and an optical receiver 123 for receiving electromagnetic radiation emitted from the transmitting optical magnetron 122. The transmitting optical magnetron 122 and optical receiver 123 are mounted on a tower 124 and can be connected to one or more servers 125 or computers that in turn are connected to a broadband network. It will be appreciated that the optical receiver 123 can be a conventional microwave magnetron or another device capable of receiving the electromagnetic radiation transmitted by the transmitting optical magnetron 122. A fixed or mobile user 126 within range of the tower 124 is provided with a transmitter and a receiver. Data can be transmitted over the system 120 using communication protocols similar to that used in other optical transmission systems. By utilizing the high power optical magnetron of the present invention, higher data-transfer rates can be achieved and many more end-users can be serviced from a given tower than in conventional systems. In addition, the greater ranges that are achievable with the optical magnetron of the present invention means fewer towers are needed to service a given area. Further details of the wireless/high-bandwidth communications systems are set forth in U.S. patent application Ser. No. 10/231,651 filed on Aug. 30, 2002, which is hereby incorporated herein by reference in its entirety.

Figure 17:
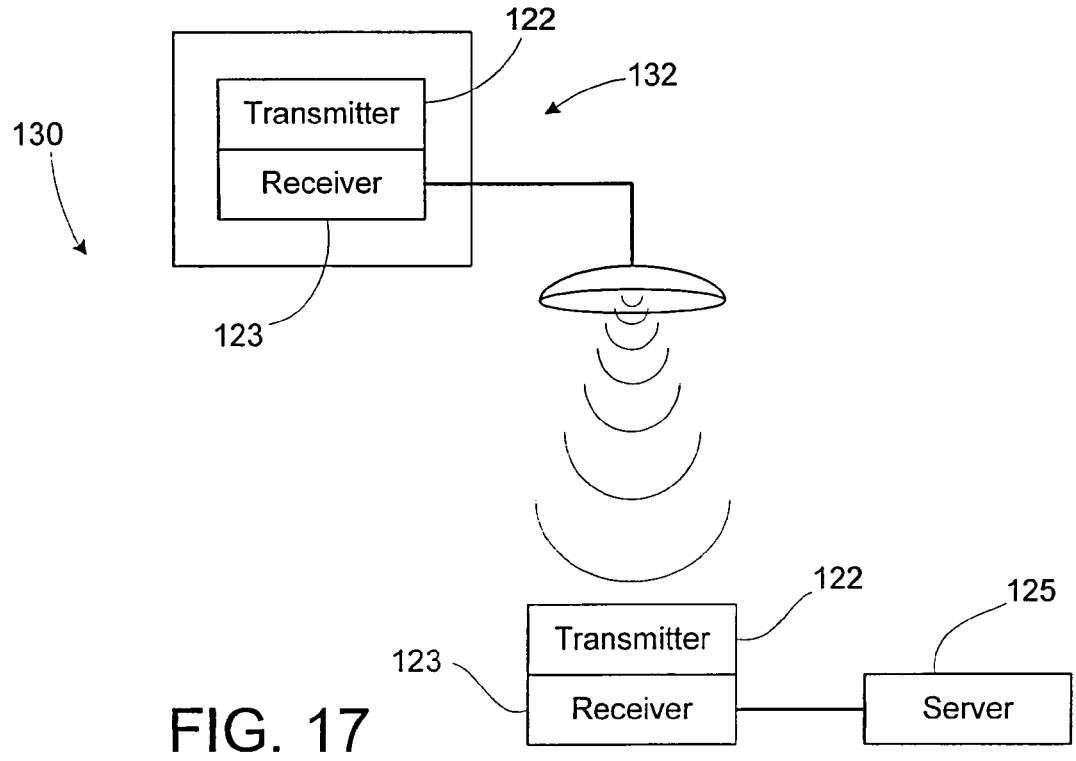
FIG. 17 is a schematic diagram illustrating a wireless/high-bandwidth communications system including an exemplary optical magnetron in accordance with the present invention.

Turning to FIG. 17, another wireless/high-bandwidth communications system 130 including an exemplary optical magnetron 122 in accordance with the present invention is shown. This system 130 is identical to the system 120 shown and described in connection with FIG. 16, except that instead of being mounted on a tower, a transmitting optical magnetron 122 and optical receiver 123 are mounted on a satellite 132 in orbit around earth. In the past, satellite communication has been limited to a relatively small portion of the microwave spectrum, which in turn has limited the available data rates. Accordingly, ground services which have almost unlimited bandwidth for long-haul applications have kept such satellite communications systems from becoming mainstream. Using the optical magnetron 122 of the present invention enables new frequency bands to be exploited for satellite communications services. By opening up larger portions of spectrum, a satellite system using the optical magnetron of the present invention will be able to directly compete with ground wired systems in terms of delivered bandwidth.

Figure 18:
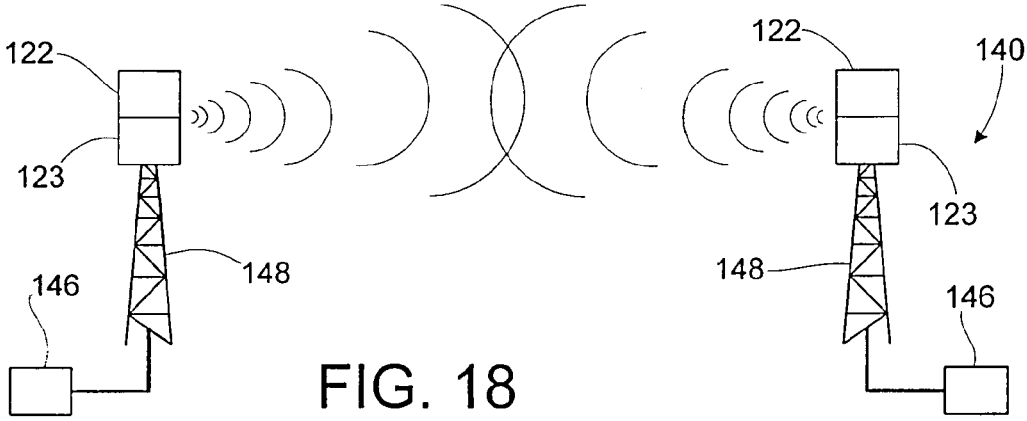
FIG. 18 is a schematic diagram illustrating an exemplary optical magnetron as part of a communication system for wirelessly transmitting and receiving data in accordance with the present invention.

In FIG. 18, an exemplary optical magnetron in accordance with the present invention is shown as part of a communication system 140 for wirelessly transmitting and receiving data. Data can be transmitted over the system 140 using communication protocols similar to that used in other optical transmission systems, such as the system 120 of FIG. 16. The system 140 includes first and second transmitting optical magnetrons 122 for transmitting optical energy and a first and second optical receivers 123 for receiving transmitted optical energy. Each optical magnetron 122 and optical receiver 123 is connected to a land-based network 146, such as a landline telephone network for transmitting telephone calls. The optical magnetrons 122 and optical receivers 123 can be mounted on towers 148 for increasing effective range. The system 140 can be part of a wireless communication system or network, commonly referred to as a cell phone network for transmitting and receiving voice calls and/or data between one or more wireless devices and/or one or more wired devices.

Figure 19:
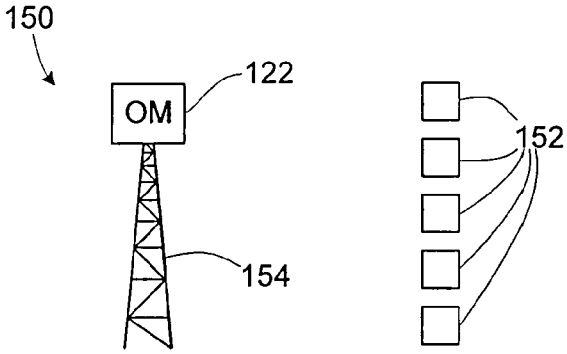
FIG. 19 is a schematic diagram illustrating an exemplary optical magnetron in a point-to-multipoint system for transmitting data in accordance with the present invention.

In FIG. 19, an exemplary optical magnetron in accordance with the present invention is shown in a point-to-multipoint system 150 for transmitting data. As will be appreciated, data can be transmitted over the system 150 using communication protocols similar to that used in other optical transmission systems. The system 150 includes an optical magnetron 122 in accordance with the present invention configured to transmit data using electromagnetic energy to a plurality of subscribers 152. The higher power transmission rates achievable with the optical magnetron 122 of the present invention results in higher data rates thereby permitting more subscribers to be serviced from a given central transmitter which may be mounted on a tower 154. Greater ranges than currently achievable are also possible with the optical magnetron of the present invention thus further reducing the number of towers needed to service a given area.

Figure 20:
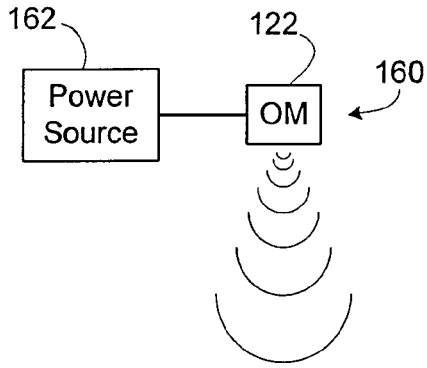
FIG. 20 is a schematic diagram illustrating an exemplary optical magnetron in a microwave process heating system in accordance with the present invention.

Turning now to FIG. 20, an exemplary optical magnetron 122 in accordance with the present invention is shown in a microwave process heating system 160. Such a system 160 can be utilized in a microwave oven, for example. The system 160 includes an optical magnetron 122 and a power source 162 connected to the optical magnetron 122. The optical magnetron 122 of the present invention greatly expands the power levels and available frequencies available to the process heating system 160 as compared to conventional systems.

Figure 21:
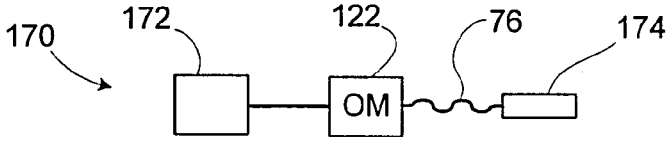
FIG. 21 is a schematic diagram illustrating an exemplary optical magnetron in a welding system in accordance with the present invention.

FIG. 21 illustrates a system 170 for welding including an exemplary optical magnetron 122 in accordance with the present invention. The system 170 includes a power source 172, an optical magnetron 122, and a welding wand 174 connected to the optical magnetron 122 via a fiber optic cable for directing the optical energy emitted by the optical magnetron 122. The system 170 can also be used for cutting various metals by heating the metal, similar to the manner in which a blowtorch is used to cut metal. Energy from the optical magnetron 122 can be focused on a target area via a focusing means (e.g., within the wand), thereby heating and/or cutting the metal.

Figure 22:
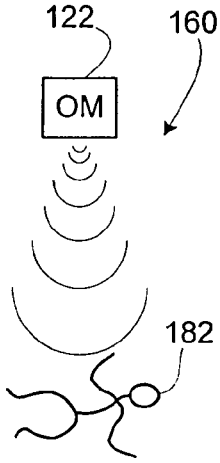
FIG. 22 is a schematic diagram illustrating an exemplary optical magnetron in a system for providing medical diagnostics and/or treatments in accordance with the present invention.

Turning to FIG. 22, an exemplary optical magnetron 122 in accordance with the present invention is shown in a system 180 for providing medical diagnostics and/or treatments. The optical magnetron 122 is configured to direct electromagnetic energy at a patient 182 to facilitate, for example, body scanning and/or imaging. The system 180 can also be used to direct treatment energy, such as tissue-penetrating microwaves for hyperthermic treatment, at the patient 182.

Figure 23:
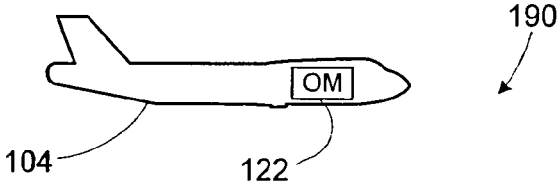
FIG. 23 is a schematic diagram illustrating an exemplary optical magnetron included in a system that can be used for applying optical energy to a broad area.
Figure 23:
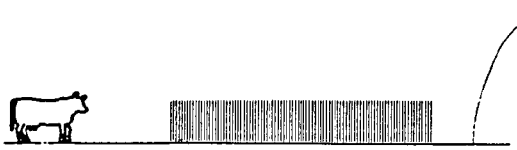

In FIG. 23, an exemplary optical magnetron 122 in accordance with the present invention is included in a system 190 that can be used for applying optical energy to a broad area, such as an agricultural field 192, for example. Energy from the optical magnetron 122 can be scanned over a target area at a particular wavelength and/or energy level etc. via a focusing means (e.g., a wave guide). Such a system 190 can be utilized for exterminating insects and/or for destroying vegetation, such as weeds. It will be appreciated that, by modulating the intensity and/or wavelength of the directed energy, certain types of vegetation and/or insects may survive while other types are eliminated. Accordingly, the system 190 can be used as a selective herbicide/insecticide to eliminate only unwanted vegetation and/or insects while leaving desired vegetation and/or insects unharmed. The system 190 can also be used to destroy seeds prior to germination thereby "sanitizing" soil prior to planting crops. The system 190 can be mounted to a vehicle, such as a tractor or an aircraft 194, or can be provided in a portable form factor that can be used in smaller applications, such as in the household. The optical magnetron of the present invention could also enable such a system, mounted on a satellite, to be operated remotely from space.

Figure 24:
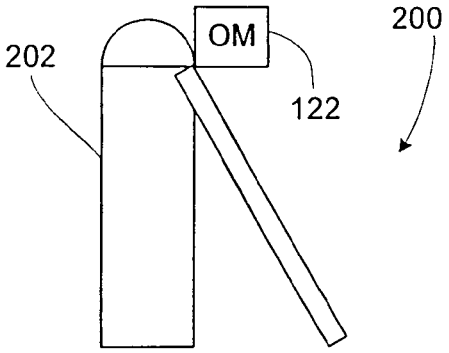
FIG. 24 is a schematic diagram illustrating an exemplary optical magnetron in a system for irradiating grain.

Another application of agricultural pest control is irradiation of grain. In FIG. 24, an exemplary optical magnetron 122 in accordance with the present invention is shown in a system 200 for irradiating grain as it enters a storage silo 202. It will be appreciated that such a system 200 can be used to irradiate grain at other times and locations, such as when loading or unloading grain from a hold on a ship.

Figure 25:
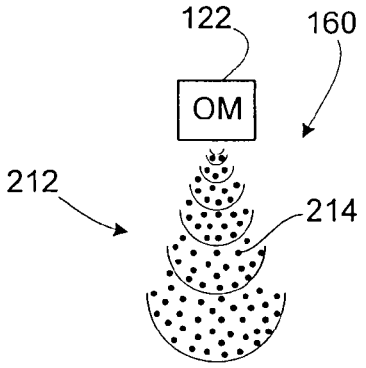
FIG. 25 is a schematic diagram of an exemplary optical magnetron in a pollution remediation system.

In FIG. 25, an exemplary optical magnetron 122 in accordance with the present invention is included in a pollution control and/or remediation system 210. The system 210 directs optical energy of suitable frequency and intensity at a polluted medium 212, such as air, for destroying and/or catalyzing pollutants 214. The system 210 can be ground based, mounted on an aircraft, or satellite based. The system 210 can be configured to treat air in the atmosphere (e.g., by broadly directing optical energy at the atmosphere). Alternatively, air can be drawn through a chamber and optical energy can be directed at the air as it passes therethrough. Alternatively, smaller versions of the system 210 can be configured to treat emissions from industrial processes and/or motor vehicle emissions. Accordingly, the system 210 can be mounted to a smokestack of a powerplant or a tailpipe of a vehicle. The system 210 can also be used in a conventional type air purifier.

Figure 26:
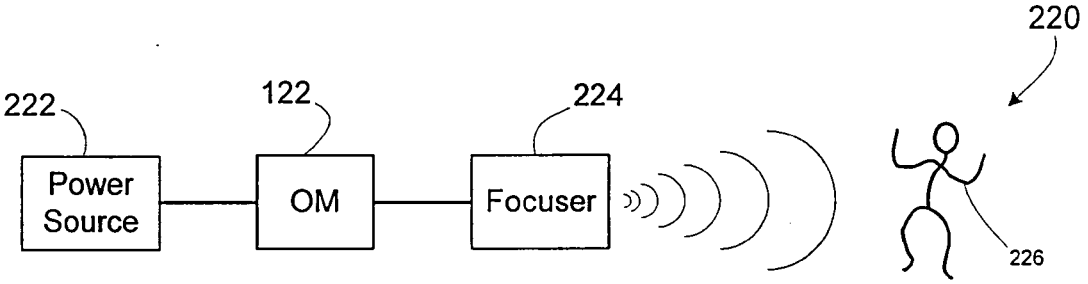
FIG. 26 is a schematic diagram illustrating an exemplary optical magnetron as part of a directed energy weapon in accordance with the present invention.

In FIG. 26, an exemplary optical magnetron 122 in accordance with the present invention is shown as part of a directed energy weapon 220. The directed energy weapon 220 includes a power source 222, the optical magnetron 122, and a focusing device 224 for focusing energy emitted from the optical magnetron at a target. The directed energy weapon can be vehicle mounted, satellite mounted, or contained in a portable unit that can be carried by a user. Stationary units are also possible. The directed energy weapon 220 can be used to apply a lethal dose of energy to a live target 226 or can alternatively be configured to apply a less than lethal dose of energy for crowd control and other purposes. The directed energy weapon 120 can also be used to destroy electronic equipment or merely jam electronic equipment by delivering optical energy at a particular frequency.

Figure 27:
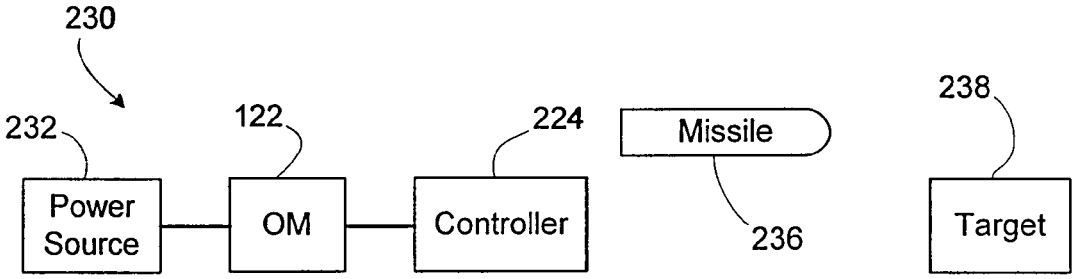
FIG. 27 is a schematic diagram illustrating an exemplary optical magnetron as part of a missile target seeking system in accordance with the present invention.

In FIG. 27, an exemplary optical magnetron 122 in accordance with the present invention is shown as part of a missile tracking system 230. The missile tracking system 130 includes a power source 232, a controller 234, and an optical magnetron 122. The system 230 can be ground-based or can be installed on an aircraft for tracking missiles and/or other projectiles and/or aircraft. Alternatively, the system can be mounted on a satellite. Such a system 230 can be used in conjunction with a missile defense system for tracking and deflecting and/or destroying enemy missiles before they reach their intended targets. In an exemplary embodiment, energy from the optical magnetron 122 is directed at an incoming missile in order to deflect the missile away from its intended target and/or to destroy the missile before impact with its intended target.

Figure 28:
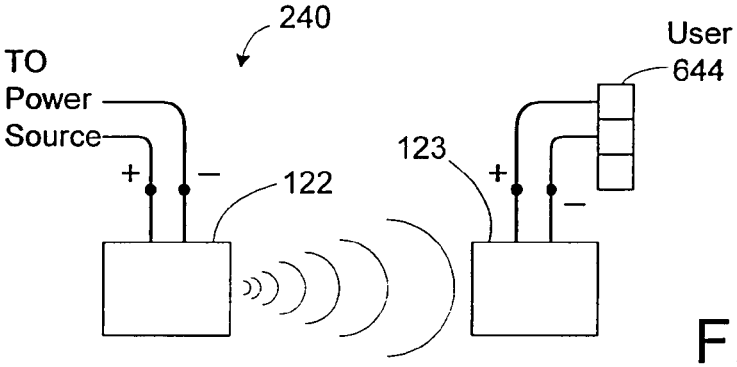
FIG. 28 is a schematic diagram illustrating an exemplary optical magnetron in a system for wirelessly transmitting electrical energy in accordance with the present invention.

Turning to FIG. 28, an exemplary optical magnetron in accordance with the present invention is shown as part of a system 240 for wirelessly transmitting electrical energy. The system 240 includes a power source or generator 242, a transmitting optical magnetron 122 connected to the power source 242, and a receiving optical magnetron 123 for receiving the wirelessly transmitted energy and converting it to electrical power. The power is transmitted in the form of electromagnetic energy. The electrical power can then be transmitted via existing power distribution lines to users 244. Accordingly, power can be transmitted through the air between the transmitting optical magnetron 122 and the receiving optical magnetron 122. As will be further described, however, the transmitting optical magnetron 122 and the receiving optical magnetron 122 can be coupled via a microwave cable, such as a fiber-optic cable, for transmitting optical energy. The system 240 can be used in place of high-voltage wire-based power transmission systems thereby eliminating high-voltage wires. This can be advantageous because microwave cables can be closely packed, unlike high-voltage wires, which permits increased capacity over existing utility right-of-ways. Further, microwave cables generally do not radiate possibly harmful electromagnetic fields to nearby structures or people.

Figure 29:
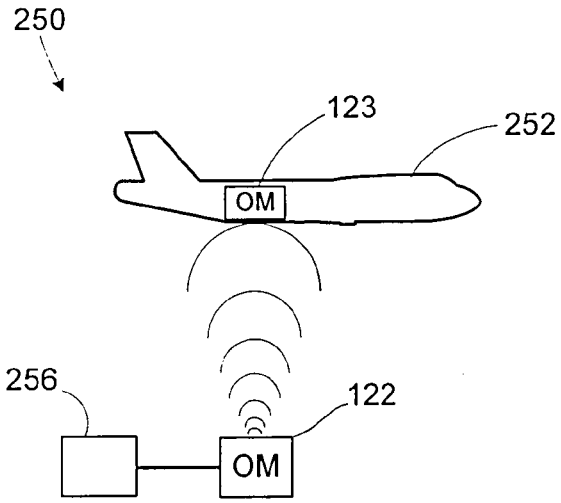
FIG. 29 is a schematic diagram illustrating an exemplary optical magnetron in a system for providing electric power to an aircraft in accordance with the present invention.

Turning to FIG. 29, an exemplary optical magnetron in accordance with the present invention is illustrated in a system 250 for providing electric power to an aircraft 252. The system includes similar components to the above-described system 240 for wirelessly transmitting electrical energy, including a receiving optical magnetron 123 mounted on the aircraft 252 for receiving electromagnetic energy from a transmitting optical magnetron 122 and converting the energy into a electric power that can be used to power one or more electric motors to propel the aircraft 252. Such a system 250 can be used to provide power not only for take-off and flight of manned or unmanned aircraft, but also for running onboard systems such as surveillance equipment, radar, etc. A tracking system 256 can be provided for tracking the aircraft and aiming the transmitting and/or receiving optical magnetrons 122 and 123 for efficient operation.

Figure 30:
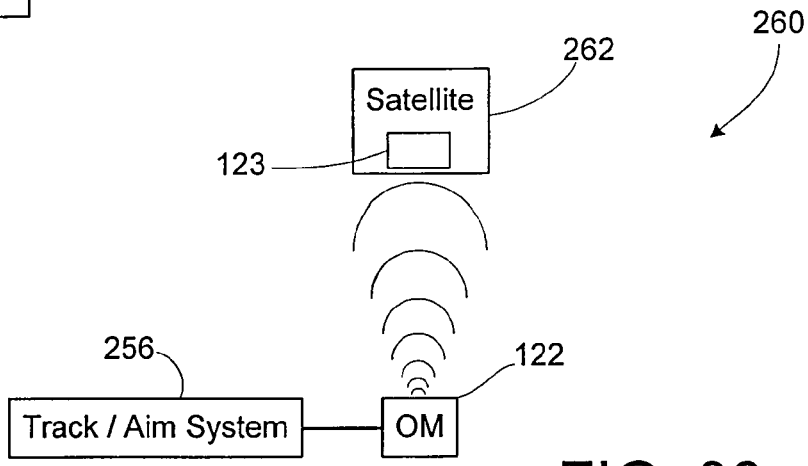
FIG. 30 is a schematic diagram illustrating an exemplary system for wirelessly providing power to a satellite in orbit.

Similarly, FIG. 30 shows a system 260 for wirelessly providing power to a satellite 262 in orbit. The system includes an exemplary transmitting optical magnetron 122 in accordance with the present invention for transmitting optical energy to a receiving optical magnetron 123 aboard the satellite 262. By transmitting power to the satellite 262 while in orbit, onboard power supplies can be smaller and/or eliminated altogether thereby reducing the weight of the satellite which in turn permits more efficient launching of the satellite. The system 260 can be used in connection with a geo-stationary satellite, in which case the transmitting optical magnetron 122 and satellite 262 are typically stationary relative to each other, and thus tracking the satellite 262 and aiming the optical magnetrons 122 is typically not critical. The system 260 can also be used with a satellite 262 that is not in a geo-stationary orbit. In such case, suitable tracking and aiming systems can be employed to aim the optical magnetrons 122 and 123. As an example, for a satellite 262 that is only visible for a few hour period at a given location on earth, a tracking and aiming system 266 can be utilized to beam power to the satellite 262 when in visible range. The satellite 262 can be configured to operate off of battery power when not in visible range, or alternatively can shut down until power transmission is once again available.

Figure 31:
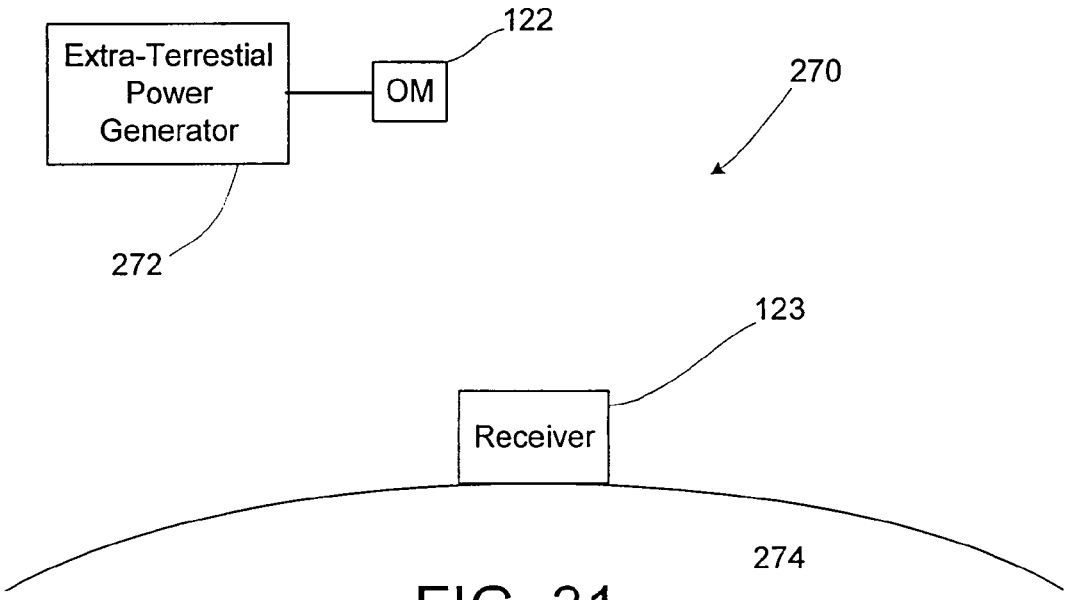
FIG. 31 is a schematic diagram illustrating an exemplary optical magnetron in a system for transmitting power from an orbiting power generation station in accordance with the present invention.

Turning to FIG. 31, an exemplary optical magnetron in accordance with the present invention is shown in a system 270 for transmitting power to earth from an extraterrestrial power generation station 272. The system 270 includes the power station 272, which can be an orbiting power station or could be located on a celestial object such as the moon or another planet, a transmitting optical magnetron 122 for transmitting the power generated by the power station 272 to a receiving optical magnetron 123 on earth 274. For example, the system 170 could be used for transmitting power from a lunar-based solar energy farm or an orbiting nuclear power plant. The system of FIG. 31 has generally the same components as the above-described optical power transmission system 240 (FIG. 24), and functions in essentially the same way. By removing power generation stations from the Earth's atmosphere, any pollution generated by such stations can be kept away from the Earth's atmosphere thereby providing environmental benefits. This is particularly the case for power generators such as nuclear power generators, which although provide a "clean" source of power still represent significant hazards to humans (radiation) in the event of a malfunction. Accordingly, the system of FIG. 24, by permitting remote location of the powerplant, avoids pollution of the Earth's atmosphere and reduces the potential for malfunctions to adversely impact humans.

Figure 32A:
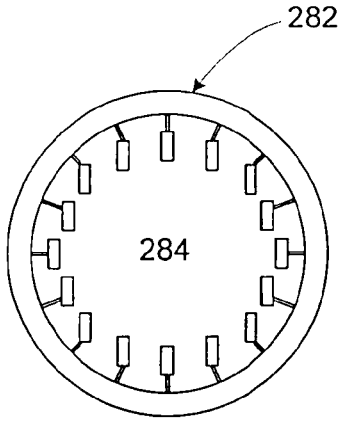
FIG. 32A is cross-sectional view taken along the diameter of an exemplary optical power cable for use in connection with such exemplary optical power transmission systems as described in, for example, FIG. 21.
Figure 32B:
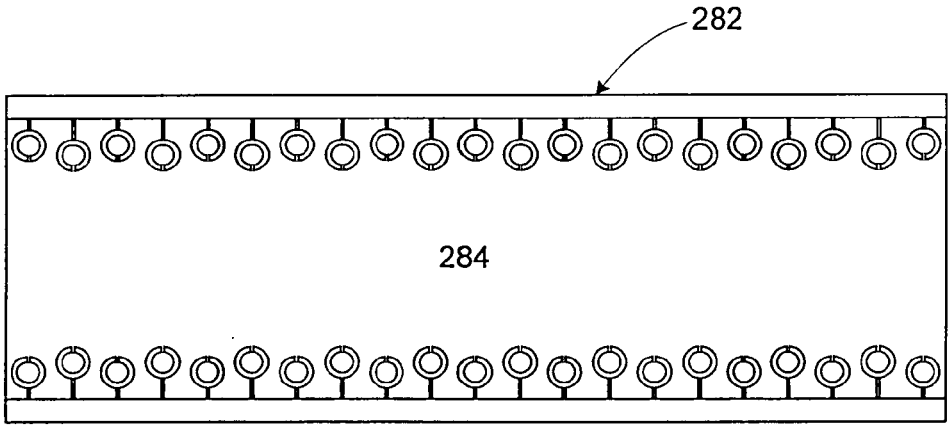
FIG. 32B is a cross-sectional view taken along the longitudinal axis of an exemplary optical power cable for use in connection with such exemplary optical power transmission systems as described in, for example, FIG. 21.

It will be appreciated that the above-described systems describing wireless optical transmission of data and/or electrical power transmission can be wireless or can include an optical cable for containing the optical energy. Turning to FIGS. 32A and 32B, an optical power cable for use in connection with such system is illustrated. The optical power cable 282 can be used to connect an exemplary transmitting optical magnetron 122 in accordance with the present invention to an energy receiving element, which maybe another exemplary optical magnetron. The optical power cable 282 can be a fiber-optic cable which permits the optical energy to travel within the cable with minimal losses and avoids scattering of the optical energy. Such a cable can also be useful in applications where line of sight aiming of the optical magnetron and energy receiving element is not possible.

The optical power cable 282 includes a generally transparent core material 284 having low absorption and scattering loss. The core material 284 can be glass, plastic, an inert gas, or a vacuum, for example. A cladding material 286 surrounds the core material 284 and serves to confine the optical power to the core material 284 and prevent leakage of the same from the cable 282. Although typically little or no optical power flows in the cladding material 286, the cladding material should preferably have low absorption and scattering loss.

Figure 33:
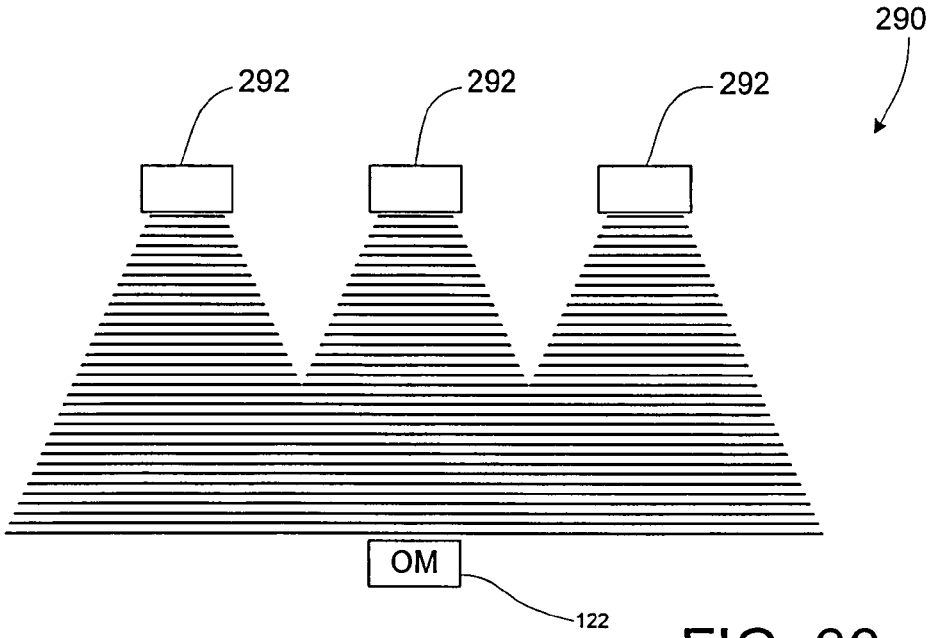
FIG. 33 is a schematic diagram illustrating an exemplary optical magnetron in a lighting system in accordance with the present invention.

Turning to FIG. 33, an exemplary optical magnetron in accordance with the present invention is shown in a lighting system 290. The system includes an optical magnetron 122 and one or more lighting units 292 that receive energy from the optical magnetron 122 and convert the energy to visible light. The lighting system 290 can be, for example, a microwave-powered electrodeless lighting system wherein the lighting units 292 are sulfur lamps consisting of a quartz bulb containing sulfur and inert argon gas at the end of a thin glass spindle. The optical magnetron 122 can be used to bombard the lamps with electromagnetic energy of a suitable wavelength to excite the gas thereby heating the sulfur into a brightly glowing plasma. Such lights can be used to replace conventional streetlights and offer potentially vastly higher efficiency than current gas discharge lamps and LED-based lamps. As an alternative, wireless energy transmitters (for example as illustrated in FIG. 23) can be used in conjunction with conventionally powered lamps to provide electrical energy to generate light. An optical cable can also be used as desired.

An optical magnetron in accordance with the invention can also be used to directly generate visible light for lighting applications. In general, directly generating light with an optical magnetron in accordance with the invention is more efficient than generating light by other means, such as, thermal or gas discharge light sources or light emitting diodes (LEDs). For example, a single optical magnetron could be used to generate light for an entire office building. A network of fiber-optic cables could be used to distribute the light to emitting structures throughout the building.

Figure 34:
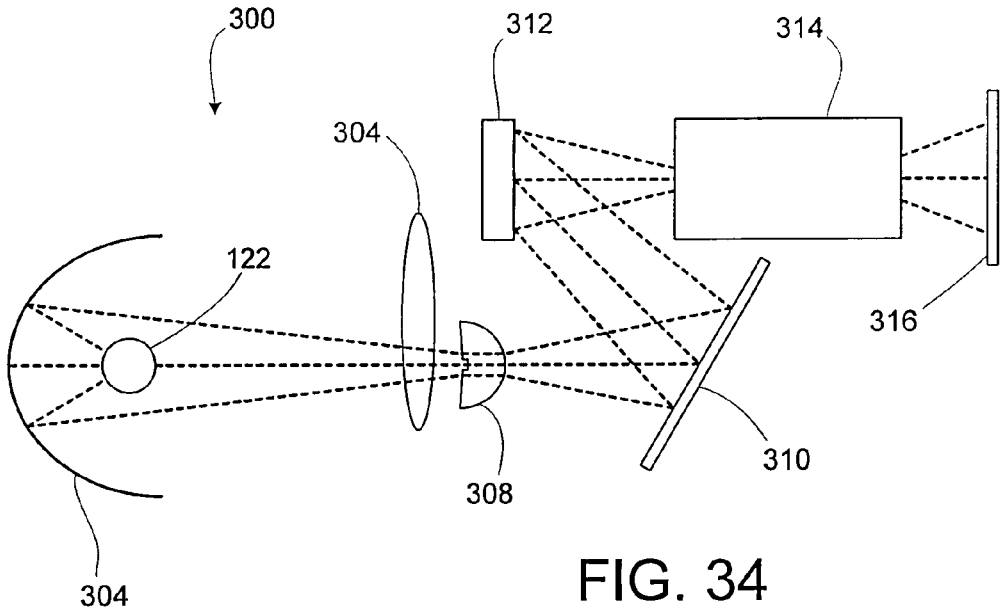
FIG. 34 is a schematic illustration of an exemplary optical magnetron in a display system in accordance with the present invention.

Turning to FIG. 34, an exemplary optical magnetron 122 in accordance with the invention is illustrated in an exemplary display system 300. The display system 300 includes the optical magnetron 122 that functions as a light source, a mirror 304, a color generator 306, a condenser 308, a reflector 310, a spatial light modulator 312, a projection lens 314, and a display screen 316. Light produced by the optical magnetron 122 travels along the illustrated path ultimately producing an image on the display screen 316. It will be appreciated that the display system 300 is exemplary, and that the optical magnetron can be used as a light source in a wide variety of display systems including rear projection systems and projector systems. It will further be appreciated that the optical magnetron can be configured to directly produce pure colored visible light and that, therefore, the color generator 306 can be omitted in certain applications.

Although the description of some of the above-described systems includes the optical magnetron 122 as set forth in FIGS. 1-15, it will be appreciated that is some applications other optical magnetrons can be utilized. Further, elements referred to as transmitters and receivers in the above-described systems can be optical magnetrons such as set forth above, or alternatively may be other optical magnetrons or other devices that can perform the transmitting and/or receiving functions.

Although the present invention has been described with reference to specific exemplary embodiments, it will be evident that various modifications and changes may be made to these embodiments without departing from the broader spirit and scope of the invention as set forth in the claims. Accordingly, the specification and drawings are to be regarded in an illustrative rather than a restrictive sense.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

The following claims are in no way intended to limit the scope of the present invention to the specific embodiments described above. In addition, any recitation of "means for" is intended to evoke a means-plus-function reading of an element and a claim, whereas, any elements that do not specifically use the recitation "means for", are not intended to be read as means-plus-function elements, even if the claim otherwise includes the word "means".

What is claimed is:

1. An electromagnetic radiation source, comprising:

an anode comprising:

a first conductor;

a second conductor positioned relative to the first conductor;

a plurality of inter-digitated pole pieces coupled to the first conductor or the second conductor, wherein adjacent pole pieces are separated by a gap;

at least one mechanical phase reversal positioned along the first conductor or the second conductor, the mechanical phase reversal operable to force a polarity change between pole pieces adjacent to the mechanical phase reversal;

a cathode separated from the anode by an anode-cathode space;

electrical contacts for applying a dc voltage between the anode and the cathode and establishing an electric field across the anode-cathode space; and at least one magnet arranged to provide a dc magnetic field within the anode-cathode space generally normal to the electric field.

2. An electromagnetic radiation source as set forth in claim 1 in combination with a welding wand for directing the electromagnetic radiation generated by the electromagnetic radiation source for welding.

3. An electromagnetic radiation source as set forth in claim 1 in combination with a power source for supplying power to the electromagnetic radiation source, the electromagnetic radiation source being adapted for process heating.

4. An electromagnetic radiation source as set forth in claim 1 in combination with a power source for supplying power to the electromagnetic radiation source, the electromagnetic radiation source being adapted for optical power transmission.

5. An electromagnetic radiation source as set forth in claim 1 in combination with a power source for supplying power to the electromagnetic radiation source, the electromagnetic radiation source being adapted for wireless/high-bandwidth communications.

6. An electromagnetic radiation source as set forth in claim 1 in combination with a wand for directing electromagnetic radiation generated by the electromagnetic radiation source for cutting.

7. An electromagnetic radiation source as set forth in claim 1 in combination with a lighting unit adapted to receive electromagnetic radiation from the electromagnetic radiation source and convert the radiation to visible light.

8. An electromagnetic radiation source as set forth in claim 1 wherein the electromagnetic radiation source is adapted for performing medical diagnostics.

9. An electromagnetic radiation source as set forth in claim 1 wherein the electromagnetic radiation source is adapted for performing medical therapy.

10. An electromagnetic radiation source as set forth in claim 1 wherein the electromagnetic radiation source is adapted for killing insects.

11. An electromagnetic radiation source as set forth in claim 1 wherein the electromagnetic radiation source is adapted for killing plants.

12. An electromagnetic radiation source as set forth in claim 1 in combination with a focuser adapted for focusing electromagnetic radiation generated by the electromagnetic radiation source at a target.

13. An electromagnetic radiation source as set forth in claim 1 wherein the electromagnetic radiation source is adapted to receive direct current and generate optical energy.

14. An electromagnetic radiation source as set forth in claim 1 in combination with an optical power receiver for receiving optical power from the electromagnetic radiation source and converting the optical power to direct current.

15. An electromagnetic radiation source as set forth in claim 1 in combination with a receive mountable to an aircraft, wherein the receiver is configured to receive electromagnetic radiation generated by the electromagnetic radiation source and convert the radiation to electrical power.

16. An electromagnetic radiation source as set forth in claim 1 in combination with a receive mountable to a satellite, wherein the receiver is configured to receive electromagnetic radiation generated by the electromagnetic radiation source and convert the radiation to electrical power.

17. An electromagnetic radiation source as set forth in claim 1 in combination with space-based power generator and an earth-based receiver, wherein power generated by the space-based power generator is converted to electromagnetic radiation by the electromagnetic radiation source, and wherein the receiver is configured to receive electromagnetic radiation generated by the electromagnetic radiation source and convert the radiation to electrical power.

18. An electromagnetic radiation source as set forth in claim 1 wherein the electromagnetic radiation source is adapted for pollution remediation.

19. An electromagnetic radiation source as set forth in claim 1 wherein the electromagnetic radiation source is adapted for photochemical processing.

20. An electromagnetic radiation source as set forth in claim 1 in combination with a display surface, wherein the display surface is configured to display an image in response to radiation generated by the electromagnetic radiation source.

* * * * *